US006170202B1

(12) United States Patent
Davoodi et al.

(10) Patent No.: US 6,170,202 B1
(45) Date of Patent: Jan. 9, 2001

(54) BUILDING SYSTEM USING SHAPE MEMORY ALLOY MEMBERS

(75) Inventors: Hamid Davoodi, College Station; Frederick A. Just; Ali Saffar, both of Mayagüez, all of PR (US); Mohammad N. Noori, Westboro, MA (US)

(73) Assignee: University of Puerto Rico, San Juan, PR (US)

( * ) Notice: Under 35 U.S.C. 154(b), the term of this patent shall be extended for 0 days.

(21) Appl. No.: 09/095,897

(22) Filed: Jun. 11, 1998

Related U.S. Application Data

(60) Provisional application No. 60/049,402, filed on Jun. 12, 1997.

(51) Int. Cl.[7] ..... E04H 9/02

(52) U.S. Cl. ..... 52/167.1; 52/167.3; 52/167.8; 52/573.1

(58) Field of Search ..... 52/167.3, 167.8, 52/167.1, 573.1

(56) References Cited

U.S. PATENT DOCUMENTS

| | | | | |
|---|---|---|---|---|
| 4,890,430 | * | 1/1990 | Kobori et al. | 52/167.3 |
| 5,065,552 | | 11/1991 | Kobori et al. . | |
| 5,375,382 | * | 12/1994 | Weidlinger | 52/167.3 |
| 5,491,938 | | 2/1996 | Niwa et al. . | |
| 5,842,312 | * | 12/1998 | Krumme et al. | 52/8 |

FOREIGN PATENT DOCUMENTS

| | | |
|---|---|---|
| 09317821 | 12/1997 | (JP) . |
| WO 95/20705 | 8/1995 | (WO) . |
| WO 96/27055 | 9/1996 | (WO) . |

OTHER PUBLICATIONS

J. N. Yang et al., "Control of Seismic–Excited Buildings Using Active Variable Stiffness Systems", Proceedings of the American Control Conference, Baltimore, Jun. 29, 1994, vol. 1, pp. 1083–1088.

Ian D. Aiken et al., "Comparative Study of Four Passive Energy Dissipation Systems", Bulletin of the New Zealand National Society for Earthquake Engineering, vol. 25, No. 3, 175–192 (1992).

Pedro Manuel Calas Lopes Pacheco et al., "Heat Transfer Analysis on Shape Memory Alloys"; COBEM–CIDIM95 Congresso Brasileiro de Eng. Mecanica–II C, Congresso Iberoameriancano de Ingenieria Meanica Belo Horizonte, Brasil, 12–15 (Dec., 1995).

Pedro Manuel C. L. Pacheco et al., "Anisothermal Analysis of Shape Memory Alloy Bars Submitted to Thermomechanical Loadings", ENCIT–LATCM– 6$^{th}$ Congress Brqasileiro de Enhenharia 3e Ciencias, Technicas, 6$^{th}$ Congreso Latinoamericano de Transferencia de Matria, Flrianapollis–SC Brazil, 11–14, pp. 791–796 (Nov., 1996).

Peter W. Clark et al., "Experimental and Analytical Studies of Shape Memory Alloy Dampers for Structural Control", SPIE vol. 2445, 241–251 (1995).

(List continued on next page.)

*Primary Examiner*—Christopher T. Kent
(74) *Attorney, Agent, or Firm*—Greenblum & Bernstein, P.L.C.

(57) ABSTRACT

A system and method is described by which the structural integrity of a building or other structure can be increased and made more resistant to earthquake damage. A structural member may be incorporated into a building structure. At least a portion of the structural member is made of a material that undergoes a shape or phase transformation in response to energy applied. This member can alter the natural frequency of the building structure from a first natural frequency to a second natural frequency when the material undergoes the transformation to make destructive resonance less likely to occur.

33 Claims, 18 Drawing Sheets

OTHER PUBLICATIONS

E.J. Graesser et al., "Shape–Memory Alloys as New Materials for Aseismic Isolation", pp. 2590–2608, J. Eng. Mechanics, vol. 117, No. 11 (1991).

Marcelo Amorim Savi et al.,Passive Vibration Control Using Pseudoelastic materials, University of Brazil, DINAME '95–VI Symposium on Dynamic Problems of Mechanics, Caxambu, Brazil, 6–10, pp. 230–233 (Mar., 1995).

Andrew S. Whittaker et al., "Structural Control of Buildings Response Using Shape Memory Alloys", USACERL Technical Report 95/22 (Aug. 1995).

Toriq Samad, "Special Issue on Emerging Technologies", IEEE Control Systems (Dec. 1997).

M. Attanasio et al., "Use of Shape Memory Alloy for Seismic Isolation Devices, " *Seventh International Conference on Adaptive Structures*, edited by Paolo Santini et al., Rome. Italy, pp. 267–276 (Sep. 1996).

Sankaran Kannan et al., "Active Control of Building Seismic Response by Energy Dissipation", Earthquake Engineering and Structural Dynamics, vol. 24, pp. 747–759 (1995).

S. Dimova et al., "Numerical Technique for Dynamic Analysis of Structures with Friction Devices", Earthquake Engineering and Structural Dynamics, vol. 24, pp. 881–898 (1995).

E. J. Graesser et al., "A Proposed Three–Dimensional Constitutive Model for Shape Memory Alloys", Journal of Intelligent Material Systems and Structures, vol. 5, pp. 78–89 (Jan. 1994).

José A. Inaudi et al., "Experiments on Tuned Mass Dampers Using Viscoelastic, Frictional and Shape–Memory Alloy Materials", First World Conference on Structural Control, pp. TP3–127 –TP3–136 (Aug. 1994).

J. M. Kelly, "Application of Shape Memory Materials for Reduction of Structural Response to Earthquake Ground Motion", Workshop on Smart and High Performance Materials and Structures (May 1993).

Robert D. Hanson et al., "State–Of–The–Art and State–Of–The–Practice in Seismic Energy Dissipation", ATC–17–1 Seminar on Seismic Isolation, Passive Energy Dissipation,and Active Control, vol. 2, pp. 449–471 (Mar. 1993).

Edward J. Graesser et al., "Fully Cyclic Hysteresis of a Ni–Ti Shape Memory Alloy", Mechanical Engineer, pp. ECB–1–ECB–28, Proceedings of Damping '93 (Feb. 1993).

José A. Inaudi et al., "Analytical and Experimental Study of A Mass Damper Using Shape Memory Alloys", Proceedings of Damping '93 (Feb. 1993).

Ian D. Aiken, et al., "Testing of Passive Energy Dissipation Systems", Earthquake Spectra, vol. 9, No. 3, pp. 335–370 (1993).

F. A. Cozzarelli, "Structural Damping with Shape Memory Alloys", NCEER Bulletin, pp. 4–7 (Oct. 1992).

T. B. Salzano et al., "Embedded–strain–sensor Development for Composite Smart Structures", Experimental Mechanics, pp. 225–229 (Sep. 1992).

A. Whittaker, "Tentative General Requirements for the Design and Construction of Structures Incorporating Discrete Passive Energy Dissipation Devices", Proceedings of the Fifth U.S.–Japan Workshop on the Improvement of Building Structural Design and Construction Practices, pp. 149–173 (Sep. 8–10, 1992).

P. R. Witting et al., "Shape Memory Structural Dampers: Material Properties, Design and Seismic Testing", National Center for Earthquake Engineering Research Technical Report (May 1992).

Craig A. Rogers, "Active Structural Control", Engineering Mechanics, Proceedings of the Ninth Conference, Edited by Loren D. Lutes et al., pp. 824–827 (May 1992).

E. J. Graesser et al., "Multidimensional Models of Hysteretic Material Behavior for Vibration Analysis of Shape Memory Energy Absorbing Devices", National Center for Earthquake Engineering Research Technical Report (Jun. 1989).

H. Davoodi et al., "Design of an Intelligent Structure", Engineering Mechanics, pp. 1553–1556 (1998).

H. Davoodi et al., "Application of Shape Memory Alloys in Vibration Control", Proceedings of the $16^{th}$ Canadian Conference of Applied Mechanics, CANCAM 97, pp. 91–92 (Jun. 1–5, 1997).

Kalle Matso, "Using SMAs to Outsmart Earthquakes", Emerging Technology, Edited by Harry Goldstein (Jan.–Feb. 1997).

"Earthquake Energy Dissipators Incorporating A Superelastic Alloy", NCEER Bulletin (Jan. 1990).

"School Notes" The San Juan Star (Tuesday, Mar. 11, 1997).

* cited by examiner

BUILDING SYSTEM USING SHAPE MEMORY ALLOY MEMBERS

CROSS-REFERENCE TO RELATED APPLICATION

The present application is based on U.S. Provisional patent application No. 60/049,402, filed on Jun. 12, 1997, the entirety of which is expressly incorporated herein by reference.

BACKGROUND OF THE INVENTION

1. Field of the Invention

This invention relates to the field of construction. More particularly, the invention relates to building structures having improved structural integrity by incorporating an adaptive control system using materials whose properties can be dynamically controlled.

2. Description of the Related Art

It is well known that an earthquake can cause serious damage to a building or other building structure. The extent of the damage depends on the vibration frequency and ground displacement or shaking. An earthquake can easily destroy a building if the earthquake frequencies coincide with one of the building's natural frequencies causing the building to resonate.

Past research shows that the number of natural frequencies in a building increase with the number of floors. When a new floor is added to the building, a new natural frequency, higher than the building's previous natural frequencies is created. This is not the only effect the new floor will have on the structure. This new frequency will shift the previous frequencies to lower values, thus making the first frequency of the structure lower. This effect makes the buildings susceptible to earthquakes of low frequencies. An example is the earthquake that occurred in Mexico City in the 1980's. This earthquake had a frequency around one to two hertz. All buildings of eight floors completely fell. Another one of this earthquake's characteristics is that even though it only registered 6 on the Richter Scale, it was accompanied by great earth displacement. Of course, multi-storied buildings are not the only building structures susceptible to earthquake damage. Recent earthquakes have destroyed one-story structures, bridges, and whole sections of elevated highways. The 1989 Loma Prieta earthquake in Northern California even threatened a sold-out baseball stadium during the World Series.

A classical tuned mass absorber was one of the first methods of vibration control applied to structures to prevent earthquake damage. When properly designed, a mass absorber will introduce an additional degree of freedom to the vibration system. This permanent change to the building will effectively cancel out the displacement of the other floors by shifting the natural frequencies of the structure. Although the system is usually used only in high rise buildings, the theory behind the operation of the absorber may be adapted to any structure.

The theory governing the operation of the mass absorber is relatively simple. The mass absorber introduces another degree of freedom to an existing system to reduce displacement at one of the structure's natural frequencies. It is a proven means of resonance prevention and displacement reduction, yet there are numerous shortcomings to this absorber system. Drawbacks of the mass absorber system include its permanent modification of a system's dynamic behavior upon its installation, its creation of another natural frequency, and its inability to adapt to changing environmental conditions.

Active Variable Stiffness (AVS) mechanisms are also used to control the vibration characteristics of a building in order to prevent resonance due to an earthquake motion, and to suppress the response of the building. The Kajima Corporation sells a type of AVS. An AVS system, as its name suggests, works by changing the stiffness of a structure. An increase in the stiffness of a building will result in an increment of the natural frequencies of the same. Thus, if the natural frequencies of a building increase, the tendency to get up to resonance in the building would be diminished.

Shape Memory Alloys (SMAs) are metallic materials that exhibit the ability to return to a previously defined shape or size when subjected to certain temperatures. An SMA has the ability to be trained for one, two, or several "memories." Materials with One Way Memory, if plastically deformed at low temperature, will experience the recovery effect of its trained memory upon heating, or activation of the alloy. The material then will maintain this recovered shape as it cools to room temperature (25° C.). This recovery effect is also known as the Shape Memory Effect (SME). In materials trained for Two Way Memory, an SMA is trained for a specific memory at both high and low temperatures. After deformation at a low temperature and upon heating of the alloy, the material will recover the form it was trained for at high temperature. Then, as the SMA cools to room temperature (25° C.), it will switch from the high temperature memory to the shape given to it during low temperature training.

Shape Memory Effect (SME) was discovered in 1932 when Read and Chang made the first recorded observation of the shape memory transformation in a gold and cadmium (AuCd) alloy. Three decades later, Buehler, Wang, and co-workers discovered this memory behavior in a nickel-titanium (NiTi) alloy. It was later named Nitinol because of the alloy components, nickel and titanium, and for the place of its discovery, the U.S. Naval Ordinance Laboratory. Buehler, Wang, and co-workers were designing a material for the use in the nose cone of torpedoes. By accident, Buehler discovered the damping characteristic of Nitinol while he was transporting two bars of Nitinol, one cooled to room temperature, and the other one still warm from the casting furnace. He accidentally dropped the cooled bar on the concrete floor, and noticed that it landed with a dull thud, like a bar of lead. Curiosity caused him drop the warm bar, and it "rang with a bell-like quality." Amazed, he cooled the warm bar and let it fall again onto the floor, and surprisingly obtained the same response as when the cooled bar was dropped before. Likewise, an accident led to the discovery of the SME, when at a conference, a member of Buehler's crew heated a piece of the Nitinol with a lighter and observed a change in shape.

When Nitinol was first discovered in the 1960's, SMA suddenly became an area of interest for vibrations applications, and other branches of science. Several types of SMAs such as CuZnAl, CuZnSn, CuZnSi, and FeMnSi have been discovered and studied since then. The research done on this material has made possible the increasing entrance of new SMA commercialized products into the markets everyday. Today, the scope of SMA application involves astronomy, energy resources, car industry, electronics, mechanics, medical equipment, and others.

Though several types of SMA have been studied, Nitinol is the most widely used of the alloys. Its approximate composition ranges from 49% to 51% of nickel (atomic weight). As with all SMA, Nitinol's SME occurs with changes in the material's temperature. At a low temperature, the Nitinol microstructure is based on a martensitic phase, while at high temperature an austenitic phase dominates the microstructure. Normally, the temperature at which the martensitic changes start, known as the transition temperature, ranges from −50° C. to 166° C. depending on the alloy composition. So, as the material is being heated at or above this transition temperature, Nitinol will start undergoing changes within its crystalline structure "reverting from the martensite to the austenite phase, and then to its parent phase." These changes occurring in its microstructure are what allow the material to recover its original shape by showing the SME.

Nitinol can be trained for more than one memory. To train a specific memory to Nitinol, it should be fixed in the desired shape (parent shape), and then heated for 5 minutes at a temperature of 500° C. This high temperature causes the atoms to arrange themselves into the most compact and regular pattern possible, resulting in a rigid cubic arrangement known as the austenite phase. Once the austenite phase is reached in all the material, and with Nitinol still fixed in the desired shape, Nitinol is allowed then to cool to room temperature (25° C.). This procedure will program the material for a one way memory. A similar procedure must be followed to program the material for a two-way memory, and so on.

Normally, at low temperature, SMA is a very flexible material, allowing for easy deformation. However, at higher temperatures, while undergoing the microstructural transformations, the material's stiffness and modulus of elasticity increase significantly. Not only do the stiffness and modulus of elasticity change hysteretically, but other properties change as well, such as thermal conductivity, electrical resistivity, and natural frequency.

Due to the hysteretic behavior of Nitinol's properties, some physical and mechanical properties of the material have been studied. Some of the more interesting physical properties under study are: Electric resistivity, thermoelectric power, Hall coefficient, velocity of sound, damping, heat capacity, magnetic behavior, and thermal conductivity. However, Nitinol's popularity among SMA can be attributed to its excellent mechanical properties including hardness, impact resistance, toughness, fatigue strength, and others. Besides showing a long fatigue life, it is non-magnetic, highly corrosion resistant, and possesses high strength, the ability to recover substantial amounts of strain, and excellent damping characteristics at temperature below transition. These characteristics have made Nitinol suitable for a multitude of applications.

One of Nitinol's first applications was its use in a hydraulic coupler used in F-14 Tomcats. Other applications vary from engine mounts, to automobile suspensions, to vibration controllers. Some biomedical applications include tweezers to remove foreign objects through small incisions, and Nitinol eyeglass frames.

SUMMARY OF THE INVENTION

The objective of this invention is to overcome the drawbacks of the prior art through the implementation of advanced materials, such as SMA's into a building structure as a means of vibration control, and provide an alternative method for structural vibration control. The components of the invention can be originally built into a building structure or retrofitted in existing structures to allow for free vibration of the structure while the system is rendered inactive, giving it one advantage over a mass absorber. Upon activation, the system alters the dynamic characteristics of the structure by creating stiffening members within the structure, reducing floor displacement over a wide range of frequencies and changing the natural frequency of the structure in a controlled manner to prevent resonance.

Additional features and advantages of the invention will be set forth in the description which follows, and in part will be apparent from the description, or may be learned by practice of the invention. The objectives and other advantages of the invention will be realized and attained by the system particularly pointed out in the written description and claims hereof, as well as the appended drawings.

To achieve these and other advantages, and in accordance with the purpose of the invention as embodied and broadly described, the invention describes a structural member adapted to be incorporated into a building structure. The member includes a material that undergoes a controlled shape or phase transformation so that the natural frequency of the building structure changes from a first natural frequency to a second natural frequency when the material undergoes the transformation. The term "building structure" as used herein should not be narrowly interpreted to be limited to multi storied buildings. Instead, "building structure" should be broadly read to include multi storied buildings, single-story residences, bridges, elevated highways, towers, factories, and similar structures.

In another aspect, the invention includes a method for improving the structural integrity of a building structure, including detecting a vibration and altering the natural frequency of the building structure by causing at least one structural member in the building structure to undergo a shape or phase transformation in response to the vibration.

Another aspect of the present application describes a building structure comprising at least one structural member including a material that undergoes a controlled shape or phase transformation so that the natural frequency of the building structure changes from a first natural frequency to a second natural frequency when the material undergoes the transformation.

It is to be understood that both the foregoing general description and the following detailed description are exemplary and explanatory and are intended to provide further explanation of the invention as claimed.

The accompanying drawings are included to provide a further understanding of the invention and are incorporated in and constitute a part of this specification, illustrate several embodiments of the invention and, together with the description, serve to explain the principles of the invention.

BRIEF DESCRIPTION OF THE DRAWINGS

The accompanying drawings, which are incorporated in and constitute a part of this specification, illustrate embodiments of the invention and, together with the description, serve to explain the objects, advantages, and principles of the invention.

In the drawings.

DETAILED DESCRIPTION OF THE PREFERRED EMBODIMENTS

Figure 1:
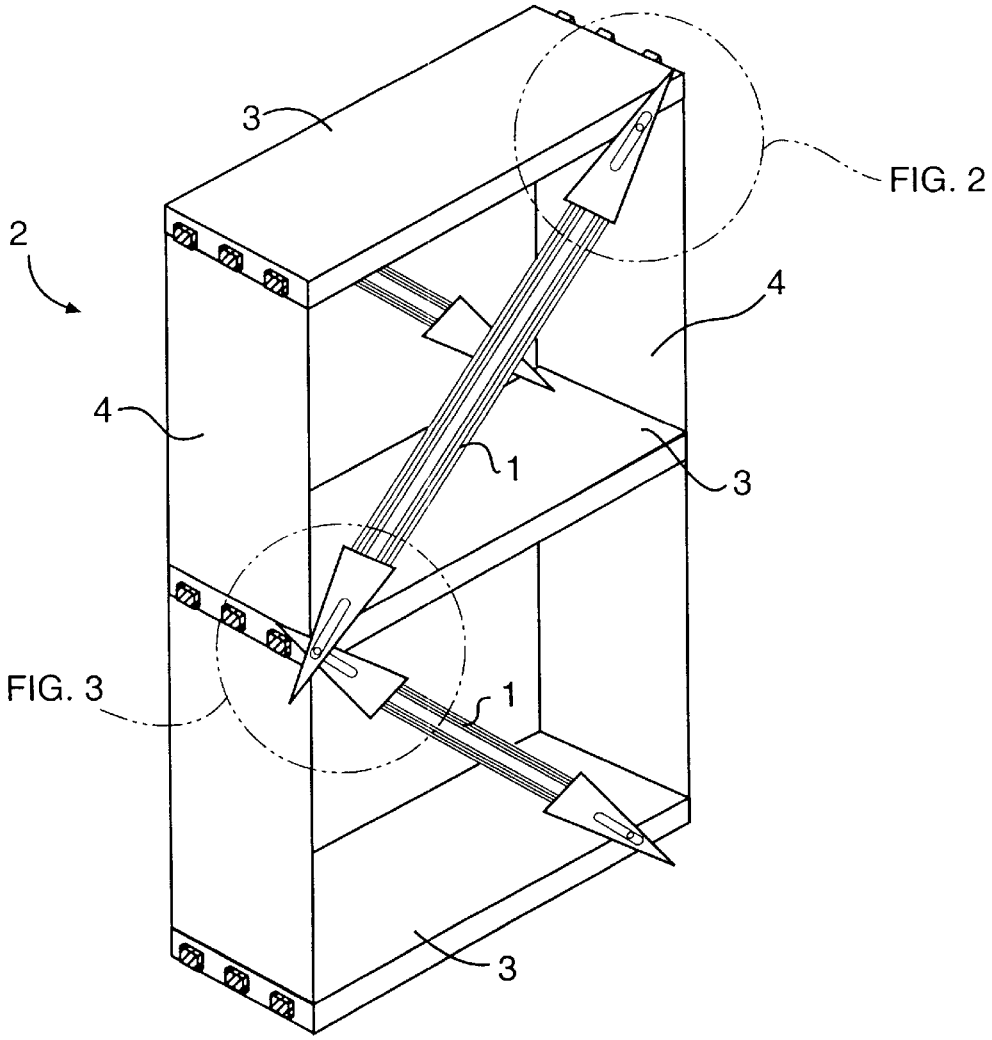
FIG. 1 is an illustration of a first embodiment of the invention.

FIG. 1 illustrates a first embodiment of the invention. This arrangement is referred to as a diagonal or X-bracing. Four structural members 1 are incorporated into a building structure 2 having floors 3 and walls 4.

The basic diagonal-configuration bracing scheme is used to add structural support to buildings and is widely used throughout the field of civil engineering. It incorporates a rigid member connected to the top corner of one floor, and to the opposite corner of the adjacent floors.

At least a portion of the structural member is comprised of a material, such as a shape memory alloy, and preferably Nitinol, that undergoes a shape or phase transformation in response to applied energy. The energy may be supplied by any known source, but is preferably heat produced by the resistance of the material itself. This can be accomplished, for example, by conductive leads attached at either end of the member. When activated, these leads carry a current that heats the member material by virtue of the material's inherent resistance. In another embodiment a heating element can be directly applied to the member instead of the electrical source.

The material can be in the form of a spring inserted into a piston located within the member 1. This piston will act as a stiffening device when activated. As the piston is stimulated, the spring concealed within the piston will begin to heat. This heat will begin the phase transformation of the spring, which in turn will force the spring to contract and pull the plunger into the piston case. When not activated, the piston will remain relaxed and should not affect the vibrational properties of the structure. The material can also be in the form of a strip or ribbon, or can be even used as the primary building structure as beams, columns, or girders.

The assembled brace should (1) reach from one corner of the floor to the corner of the other, (2) have enough room to accommodate for multiple pistons or strips, (3) allow a force to be applied to the joint when activated, (4) allow the floor to displace without plastically deforming the piston, and (5) allow the brace to pivot as the structure vibrates.

The structural members of the invention are capable of altering the natural frequency of the building structure from a first natural frequency which may coincide with the frequency of the earthquake, to a different natural frequency when the material undergoes said transformation. This change in natural frequency, in addition to the stiffening effect that members have on the building structure, significantly reduces the building displacement at any frequency of excitation. When the SMA is said to be activated it means that current is flowing through it and the stiffness of the SMA member will increase, otherwise when it is not activated the SMA members would act almost as if they were not there.

The member may be made from different materials such as lexan and aluminum. Preferably, thin material stock may be used for several reasons. First, the compression of the spring will cause the members to be pulled into tension rather than compression. This eliminates the possibility that the member will buckle as a force is applied. Second, less material means less mass which means less effect on the building's natural frequencies when the system is inactive. Lastly, it allows the member to be mounted as close to the structure as possible, thereby reducing bending moments.

The reason for choosing the different materials is as follows. The piston needs one lead of the electric current to be attached to the plunger head. It is at this same point that the link is connected to the piston. In order to prevent current passing through the link and into the building, causing a short, the link may be made of an electric insulator, lexan. Also, this link need not be insulated.

As can be seen in FIG. 1, each end of the structural member is attached to a different floor of the building structure. These members allow relative movement between the first and second sections of the building structure until the material is activated and undergoes the phase transformation. One way of ensuring that the braces do not interfere with the structure or natural frequency of the building in which they are placed is by using a different number or geometry of material strips or pistons. This enables the flexibility of changing the piston configuration if the applied force induces a stiffness too high or too low.

Figure 2:
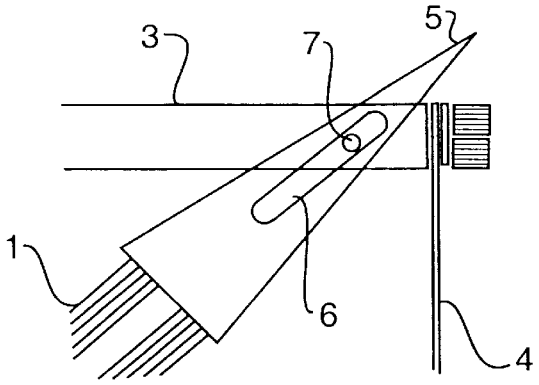
FIG. 2 is an exploded view of a feature of the invention of FIG. 1.
Figure 3:
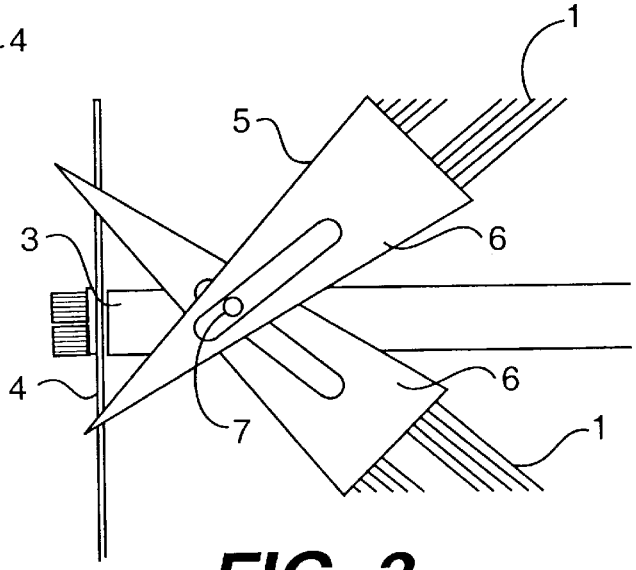
FIG. 3 is an exploded view of another feature of the embodiment of FIG. 1.

Another way is through the use of slotted and pivoting links. As shown in FIGS. 2 and 3, a slot 6 may be milled into the longer of the two links 6. This slot acts as a slider joint between the link and the floor and allows the member to maintain some freedom for the brace to displace with the floor. The other link has an oversized hole which allows it to pivot freely. When the entire member is assembled rigidly, one end will displace as the other rotates.

When the system is not activated, the member allows the walls of the structure to vibrate freely. But when activated, the material contracts and forces the slotted piston toward the other. This slot was designed to slide until the member is 20% contracted. At this point the slot is pulled tight to the bolt 7 and induces the stiffness into the building, decreasing the displacement. While a bolt is the preferred attaching means for this embodiment, any known alternative can be used. If the designer deems that the sliding movement is not necessary, other rigid attachments can be used such as welding, rivets, screws, nails, or clamps.

Thus, in addition to its requirement to reduce displacement over a large range of excitation frequencies, the SMA should also be a passive component of the structure when rendered inactive. The bracing system should allow for free movement of the building when SMA is inactive and increase the stiffness in the structure when activated. The ability to change the dynamic characteristics of a building would be the most attractive feature of SMA bracing, allowing a building to adapt to changing environmental conditions.

While the figures illustrate the bracing members being situated at the outer walls of the building, those skilled in the art will understand that many bracing systems may be contained in the core of the building rather than at the walls.

The system allows the structure to vibrate when inactive. But it should be noted that the relaxed system introduces a sizable portion of damping to the building. So from the beginning, the structure does not vibrate as freely as it would without the system. However, the tension of the members can be adjusted to attempt to match the vibrational characteristics of the unbraced structure. As the system is activated the members will induce a decrease in floor amplitude via the stiffening and damping properties of the SMA. All three bracing systems were designed to decrease the structure's amplitude at each floor.

In controlling the vibration characteristics of the member material and to accurately change the damping ratio of the structures natural frequency, an accurate temperature control is important. For practical purposes, a fast response time and minimal overshoot of the target transition temperature would be advantageous. Overheating of the material may cause detrimental thermal expansion. However, controlled thermal expansion may be advantageously used in certain embodiments of the invention.

In order to activate Nitinol's memory, heat may be supplied. The heat provided to the Nitinol may be generated through its electric resistance to current. In order to prevent inductance or capacitance properties of the Nitinol, DC current should be used. The temperature is preferably controlled by the amount of time the power supply is activated, not the magnitude of the current. A thermocouple that measures a voltage difference between two different materials can be attached to a Nitinol strip to act as a sensor in a feedback control loop. This control system acts as a thermostat—when the Nitinol reaches a maximum temperature the loop stops until it cools down to a specified temperature where it starts again. In addition to a heating system, a cooling system may also be added to improve the reaction times of the member.

The preferred control system possesses the following characteristics:

1. Rapid SMA response—In the event of an earthquake fast speed of response is important. This involves using large amounts of energy.

2. Real time control—This avoids delays of cumbersome calculations

3. Feedback loop—Since conditions vary, the exact state of the SMA must be known 4. Automatic Preferably, the control system permits one to monitor the frequency of the vibration acting on said building structure and continually change natural frequency of the building structure such that none of the natural frequencies of the building structure match the frequency of the vibration.

Figure 5:
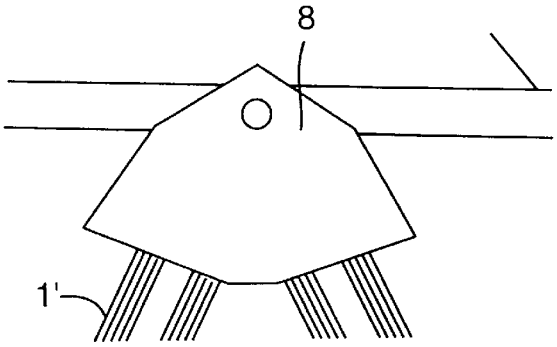
FIG. 5 is an exploded view of a feature of the embodiment of FIG. 4.
Figure 4:
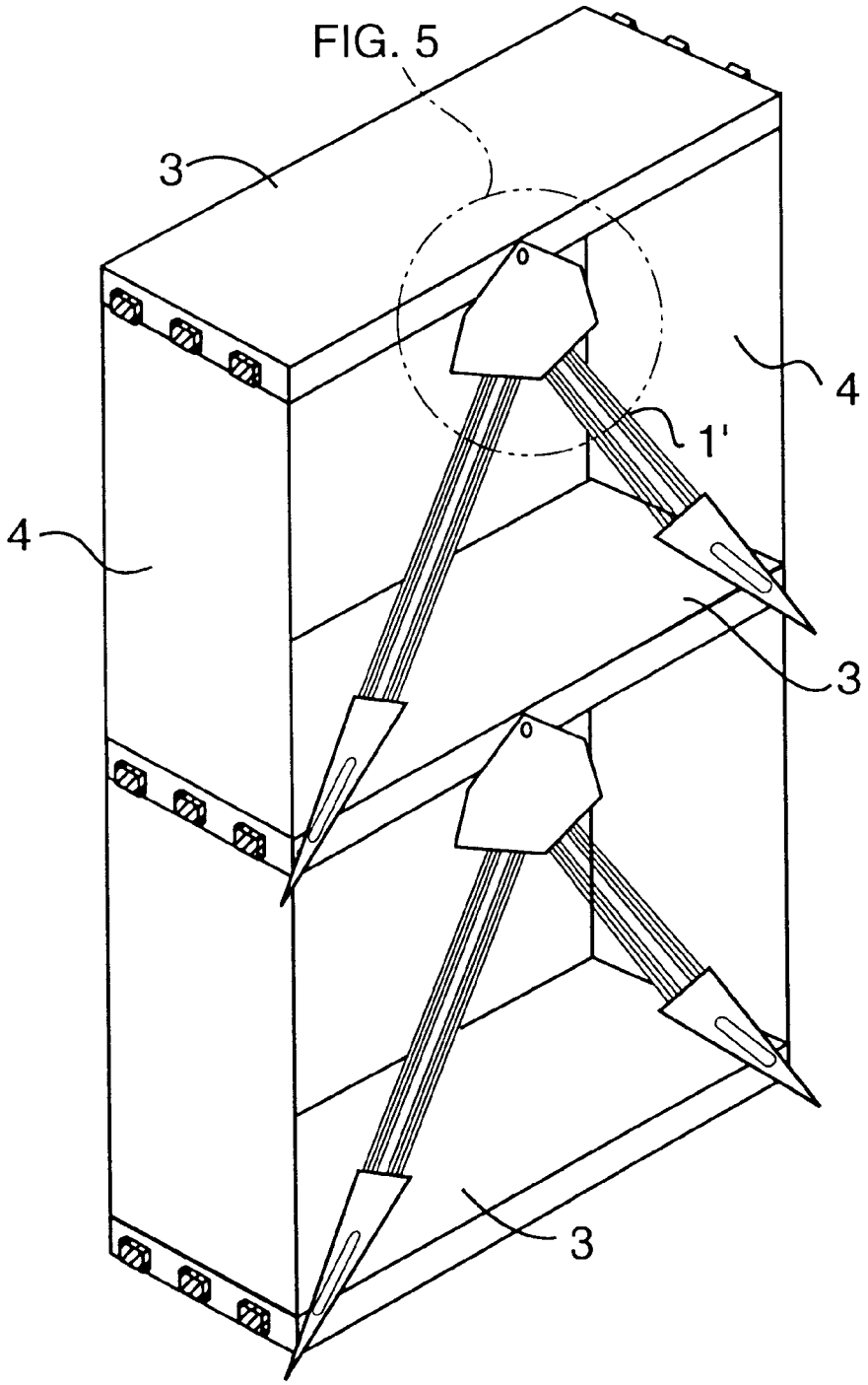
FIG. 4 is an illustration of a second embodiment of the invention.

Another bracing design, referred to as the V-bracing system, is illustrated in FIG. 4. The biggest difference between the diagonal and V-bracing system is the geometry. The V-bracing system utilizes two legs 1' per floor rather than one. In this configuration, one end of the two legs are mounted at opposite corners on the same floor. The other ends are mounted to the center of the upper floor, resulting in an inverted V shape meeting at the center bell-shaped link 8. See FIG. 5.

The objectives of this bracing system are identical to that of that the Diagonal-bracing system. It must have the ability to (1) reach from one corner of the floor to the center of the other, (2) have enough room to accommodate for multiple pistons, (3) allow a force to be applied to the joint when activated, (4) allow the floor to displace without stretching the piston, and (5) allow the brace to pivot as the structure vibrates.

The design and operation of the V-bracing links is similar to that of the diagonal-bracing system. In fact, the slotted link design is exactly the same, and for the same reasons. The bell shaped link 8 also allows for the mounting of pistons, six in all, three for each leg 1' in the preferred embodiment. This link also has an oversized hole to allow for a pivot, as the members displace with the floors.

Again the bracing allows the structure's floors to vibrate freely when the piston is relaxed. As the pistons are activated the slotted links are pulled toward the joint and then pulled tight against it. This force induces the stiffness to the structure and decreases the amplitude.

Figure 6:
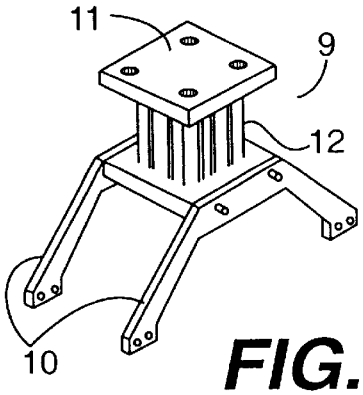
FIG. 6 is an illustration of a third embodiment of the invention.

A further bracing system embodiment illustrated in FIG. 6, uses ribbons rather than springs to alter the natural frequency of the building structure. This inverted Y-shaped system 9 includes a rigid link 10 extending from each corner of the lower floor which meet at a point before contacting the floor above at 11. Between this point and the upper floor are several flexible elements 12 which act as energy absorbers when the floors vibrate. When activated, the stiffness of the elements 12 continues to change. This continual change in stiffness introduces a continual change in natural frequency. Making the possibility of structural resonance more and more improbable. Furthermore a specialized control system may be implemented to activate certain members at certain times, further reducing the probability of resonance.

This embodiment may also utilize a series of spacers distributed along four different threaded rods. These rods serve two purposes. They act as rails for which the spacers can slide along in one direction, while permanently fixing them into the device. They also act as screws which allows the user to tighten these spacers by means of a series of nuts. It is this clamping force which holds the elements within the device.

Insulated spacers may be used between the building and the SMA material to prevent shorts in the frame while ensuring that the circuitry for the system is kept in series. Copper jumpers are preferably fixed to the lexan spacers to deliver the current to the appropriate member. The SMA may then be wired in series using a conductor-insulator-conductor-insulator approach.

Figure 7:
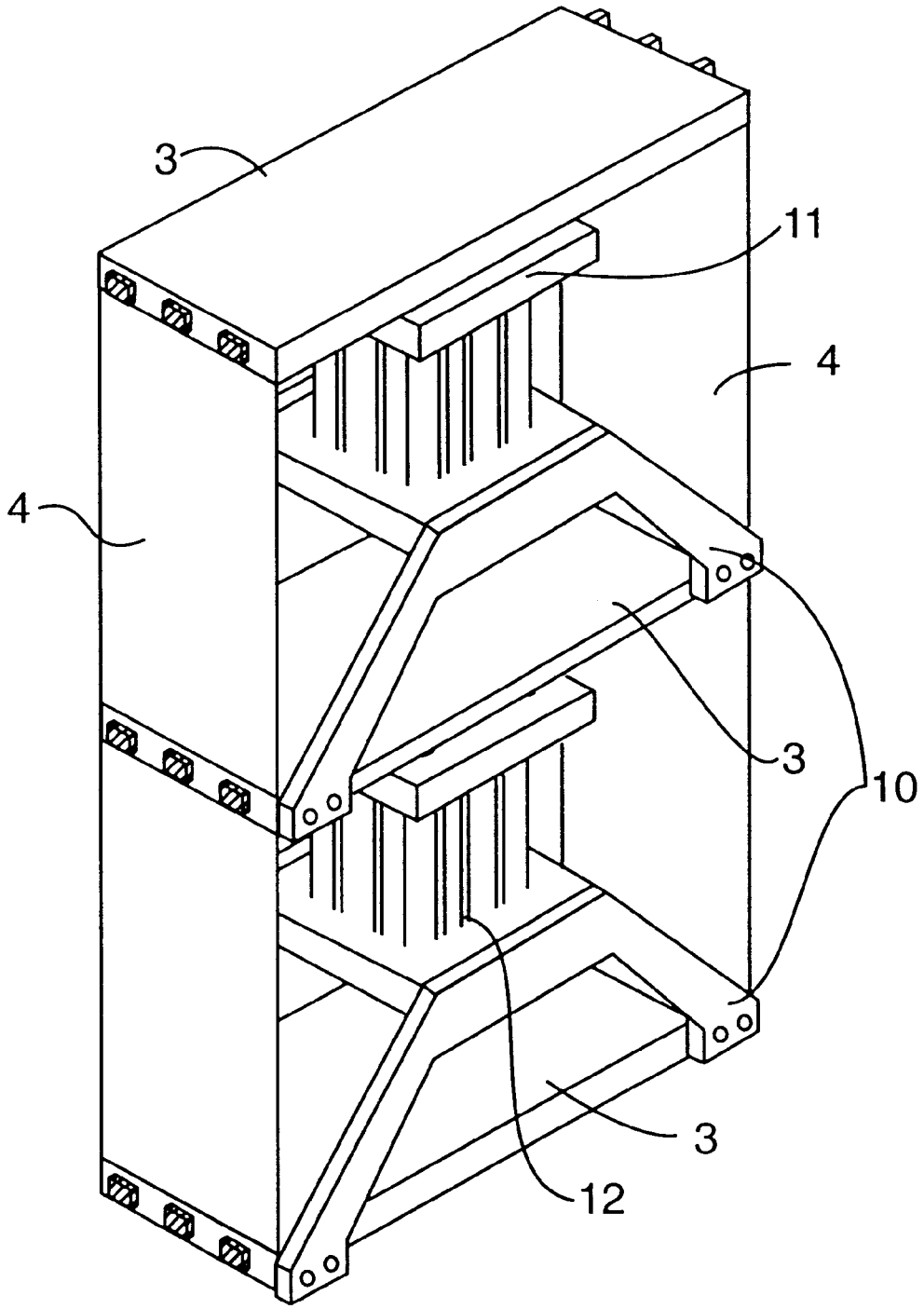
FIG. 7 is an illustration of the third embodiment in place in a structure.

The configuration is then assembled with both top and bottom clamps and incorporated into the structure as shown in FIG. 7.

In order to determine the performance of the structural members of the invention relative to a mass absorber, a scale model structure was developed with the aid of a mathematical model. First and foremost, the structure was to simulate the dynamic behavior of a typical two-story building. This means that the model should vibrate and resonate exactly as an actual two-story building would. Simulation of the building's natural frequencies represent the most crucial aspect of the model's construction, and must be satisfied above all other design criteria. The first and second natural frequencies of a typical two-story building range from 4.5–5.5 Hz and 13–15 Hz, respectively. It is critical that the model's natural frequencies fall within these ranges as well. The model must also be able to simulate the mode shapes and floor displacements associated with a two-story building.

In order to create an actual scale model representation of a two-story building under base excitation, a mathematical model was created. This model determined the geometric and metallurgical properties required to create a model which simulated the dynamic behavior of a two-story building. This dynamic behavior included precise representation of a two-story building's natural frequencies, mode shapes and floor motion under base excitation.

These mathematical models needed to be flexible in order to allow for easy modification of the system to fine tune the simulation. This entailed the creation of a dynamic model which will automatically update parameters governing the behavior of the system by adjusting critical system variables. Formulation of such models will enable the designer to see how certain variables will effect the overall behavior of the system and freely adjust these variables accordingly. In addition, multiple designs may be made with ease, allowing the designer to pick and choose what combination of geometric proportions and material selection best fit the need of the experimental setup.

In order to facilitate the design process, a Microsoft Excel model was created to obtain an idea of what combination of materials and geometric dimensions would be required to simulate the natural frequencies of a two-story building. As stated before, the natural frequencies of the model are the most important aspect of its dynamic behavior and maintain priority over all other design criteria.

This mathematical model calculates the first two natural frequencies of the structure through material selection and the definition of floor and wall dimensions. These variables give the parameters which defined the natural frequency, namely the stiffness of the walls and the mass of the floors. We found this model to be very useful as it gave a rough idea of what scale and composition the model would have. Although it was not a detailed vibrational analysis, it produced fairly accurate results regarding the natural frequencies of the building. Furthermore, it proved to be extremely flexible, allowing the analysis of many materials and dimensioning schemes with tremendous ease.

The Microsoft model provided some insight into a suitable combination of dimensions and materials needed to produce an accurate simulation of a two-story building's natural frequencies. However, the model was not a detailed vibrational analysis. Using Mathcad, a detailed vibrational analysis of a two degree of freedom system ensured that the dynamic behavior of the model would be representative of a typical two-story building. This included the precise calculation of the model's natural frequency, mode shapes and floor displacements under various base excitations.

The first step in the construction of the Mathcad model was to define the critical design variables such as floor and wall dimensions, along with their composition and masses. Similar to the Microsoft model, these variables could be readily changed to fine tune the behavior of the system in its entirety. This feature of the model greatly enhanced our capability to create a proper simulation for experimentation.

Unlike the Microsoft model, the Mathcad model worked in a matrix format, carrying the majority of its calculations out using linear algebra. For instance, the design variables input at the beginning of the program would create a mass matrix ($M_{gen}$) and a stiffness matrix ($K_{gen}$). These matrices were used through the analysis of the motion of the building's floors using Newton's Second Law:

$$[m]x+[c]x+[k]x=F_t \tag{1}$$

where:

[m]=mass matrix of the structure x=displacement of the structure

[c]=damping matrix

[k]=stiffness matrix

Ft=force applied at the structure's base

Once properly formulated, the matrices would serve as the basis upon which all critical parameters of the model's dynamic behavior would be calculated. The first step in analyzing the model would be to verify the Microsoft model's calculation of the system's natural frequencies. This was accomplished by determining the eigenvalues of the mass and stiffness matrices using the eigenvalue function of Mathcad. The natural frequencies were obtained by taking the square root of the eigenvalue matrix. The next equation shows the command in Mathcad to obtain the eigenvalues from the stiffness and mass matrixes, from the eigenvalues you can obtain the natural angular velocity, and from the angular velocity you can obtain the model's natural frequencies.

$$\lambda 2=\text{eigenvals}(K_{gen},M_{gen}) \tag{2}$$

$$\omega=\sqrt{\lambda 2}=\begin{pmatrix}32.562\\85.249\end{pmatrix}\frac{\text{rad}}{\text{sec}} \tag{3}$$

-continued $$f = \frac{\omega}{2\pi} = \begin{pmatrix} 5.182 \\ 13.568 \end{pmatrix} \text{Hz} \tag{4}$$

where:

λ=eigenvalues of the model

ω=natural angular velocity of the model f=natural frequency of the model

The values obtained in Mathcad show a 0.8% of difference to those obtained in the Microsoft Excel model due to the program's rounding errors, proving the validity of both sets of calculations. The natural frequencies of the model fell within the range set forth in the design criteria, satisfying the most crucial requirement for the basic structure. The next step was to calculate the mode shapes and floor displacements of the structure to see whether measurable vibrational amplitudes could be attained during experimentation.

These mode shapes determine the way in which the building will vibrate when subjected to base excitations. The two degrees of freedom system possesses two natural frequencies and therefore two mode shapes. The mode shapes were calculated first using the eigenvector function of Mathcad:

$$\phi_1 = \begin{pmatrix} .526 \\ .851 \end{pmatrix}$$

$$\phi_2 = \begin{pmatrix} .851 \\ -.526 \end{pmatrix}$$

where: $\phi_{1,2}$=mode shapes of the model

These mode shapes define the motion of the building when subjected to a base excitation. For example, an excitation at the structure's first natural frequency will produce the first mode shape. Here, the floor displacements are expressed as a ratio, where for every 0.526 in. the first floor moves the second floor will move 0.851 in. The second mode shows the floors to be moving in opposite directions when the building is excited at its second natural frequency. These mode shapes do not represent actual floor displacements, but describe the motion of the floors relative to one another.

The mode shapes can help determine if the building will undergo oscillations which may be unstable, possibly leading to structural failure. A stable system with well-defined mode shapes should be able to endure oscillations caused by base excitation and still maintain its structural integrity. This is a critical factor in the model's design as it would be subjected to a great deal of vibrational experimentation.

Lastly, the model's actual floor displacements must be calculated. These calculations are quite lengthy and somewhat complicated. First, the coupled equations of motion had to be derived from examining a free body diagram of the model and applying Newton's Second Law Ed. 1 to the system:

$$m_1\bar{x}_1+(K_1+K_2)x_2-K_2x_2=0 \tag{5}$$

$$m_2\bar{x}_2+K_2x_2-K_2x_1=F_t \tag{6}$$

Next, a differential equation had to be formulated to describe the motion of the system:

$$\phi^T[M_{gen}](\phi)(\bar{q})+\phi^T[K_{gen}](\phi)\ (q)=\phi^T F_t \tag{7}$$

Assuming a sinusoidal input excitation and solving the above differential equation the uncoupled equations were obtained in the form:

$$q_i(t) = \frac{-\phi K_i Y}{\omega_i - \omega_{base}}\left[\sin(\omega_{base}t) - \frac{\omega_{base}}{\sqrt{\omega_i}}\sin\left(\sqrt{\omega_i}\ t\right)\right] \tag{8}$$

Finally, the actual displacements of the floors in the model are calculated. The equations were derived from the uncoupled equations of motion, which were then multiplied by the eigenvectors of the system:

$$x_1=q_1(t)\cdot\phi_{(1,1)}+q_2(t)\cdot\phi_{(1,2)} \tag{9}$$

$$x_2=q_1(t)\cdot\phi_{(1,2)}+q_2(t)\cdot\phi_{(2,2)} \tag{10}$$

The determination of floor displacement is a vital element in the experimentation portion of a project. The success of each type of each bracing system would depend on the degree in which the displacement of the structure's floors will be reduced when the bracing system is introduced into the system.

The vibrational analysis of the three-degree of freedom is identical to that of the two degree of freedom system. The only exception being the addition of a third mass and stiffness to the two degree of freedom system, due to the introduction of the mass damper to the system. The mass absorber's mass and stiffness had to be fine-tuned (different arrangement than those of design could deviate results from truth) to achieve the desired vibration reduction at the structure's first natural frequency. Once determined, the mass damper was modeled accordingly. The configuration of the mass damper being incorporated into the design consisted of a vertical cantilever beam attached to the top floor of the structure with a mass suspended from the end of it.

This change in the system was minor and did not affect the calculations in the Mathcad model, as the calculations are set up in matrix form. The flexibility of the mathematical model allows for the addition of multiple masses and springs with only minor changes to the equations which govern the dynamic behavior of the model. The only significant changes occur in the mass and stiffness matrices, which must reflect the addition of any components to the structure. Also, additional equations of motion must be written to describe the displacement of the additional components.

These changes were carried out successfully and the mass absorber produced satisfactory theoretical results. The displacement in the model was reduced at the first natural frequency of the two degree of freedom system, and the natural frequencies of the system were shifted accordingly, putting to rest any fears of the system becoming unstable with the addition of the mass absorber.

In short, the mathematical models produced satisfactory theoretical results and enabled the beginning of the construction process.

Once the analytical models have been completed and satisfactory results obtained, the actual model was built.

It was intended that the model's construction be kept as simple as possible. Complex designs are difficult to manufacture and even harder to experiment with. The design should take into account interaction with all components of the system as well as all data gathering devices.

Similarly, the structure must be able to accommodate all types of bracing schemes as well as the mass absorber. The structure should be able to employ any type of bracing used in structural engineering today. Furthermore, the model should be able to change from one bracing scheme to another with ease. Time saved in easy manipulation of the bracing components will allow more time for a thorough investigation of the bracing effects on the structure.

Lastly, the building must maintain its structural integrity when subjected to continuous dynamic loads. The model would be useless if it is not able to withstand the experimentation of continual vibrational testing. Therefore, material selection became an important factor in the structure's design. The material selected needed to be lightweight, flexible, durable and easy to machine, these were the main reasons for the selection of aluminum. It had the essential qualities for creating a model that can stand up to the rigors of vibrational testing while exhibiting the low frequency resonance conditions of a two-story building.

Due to the nature of the experimentation, a rigid base is an essential component of the testing system. External vibrations can introduce significant error into calculations, but only the input excitation should act upon the structure. Hence, the supports supporting the shaker and the model must be completely rigid, and these supports must be anchored to a rigid base.

In order to satisfy these requirements a large, flat and heavy base would need to be employed along with the use of a shaker table to ensure a rigid vibration free base. If designed correctly, the system should minimize any outside vibrations that may be introduced into the system.

Alignment of system components is another concern when trying to minimize the introduction of error. The shaker drive and the connecting point on the base of the structure should be perfectly aligned. This is required to ensure the force and displacement being output by the shaker are the same as those being input into the structure's base.

Misalignment may be prevented by allowing the system components such as the shaker mount and structure mount to be adjustable in the horizontal and vertical plane. In addition, a precision linear slide should be utilized to ensure the model moves in only one direction. Fine tuning of the alignment may be achieved by the coupling device connecting the shaker to the model. This portion of the system must also be rigid, not allowing for any slack between the model and the shaker.

A vibrational analysis determined that the structure did indeed reproduce the natural frequencies of a two-story building. Further investigation into the mode shapes of the design demonstrated that the model to be far more flexible than the other models, yielding greater floor displacements, but in a stable fashion.

Figure 8:
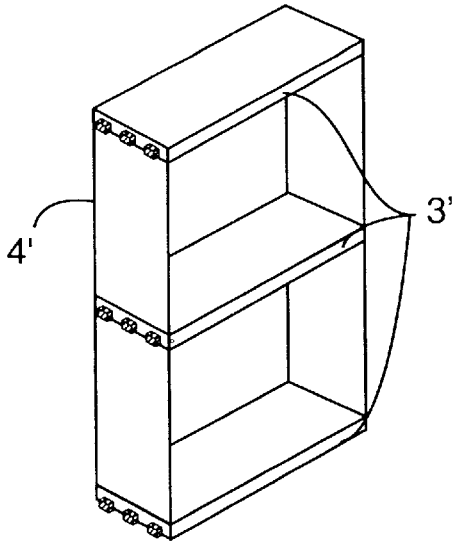
FIG. 8 is an illustration of a model used to test embodiments of the invention.

The model is illustrated in FIG. 8 and utilized a portal frame, composed of three floors 3' and two solid walls 4'. This configuration maximizes strength through the direct connection of the walls to the floors. Likewise, aluminum caps were placed over the connection point of the wall to the floor to distribute the loading applied by the screws, while also maximizing the fixed beam effect in the structure's walls.

The model construction allowed for easy modification of the structure through the aluminum's excellent machining properties. This allowed for virtually any type of bracing scheme to be applied to the model simply through the machining of a bolt hole. Similarly, the strength of the aluminum furnished an excellent base in which to anchor any bracing scheme. Data gathering equipment could also be easily applied to the structure at any number of areas on the model, aiding in the experimentation process.

Figure 9:
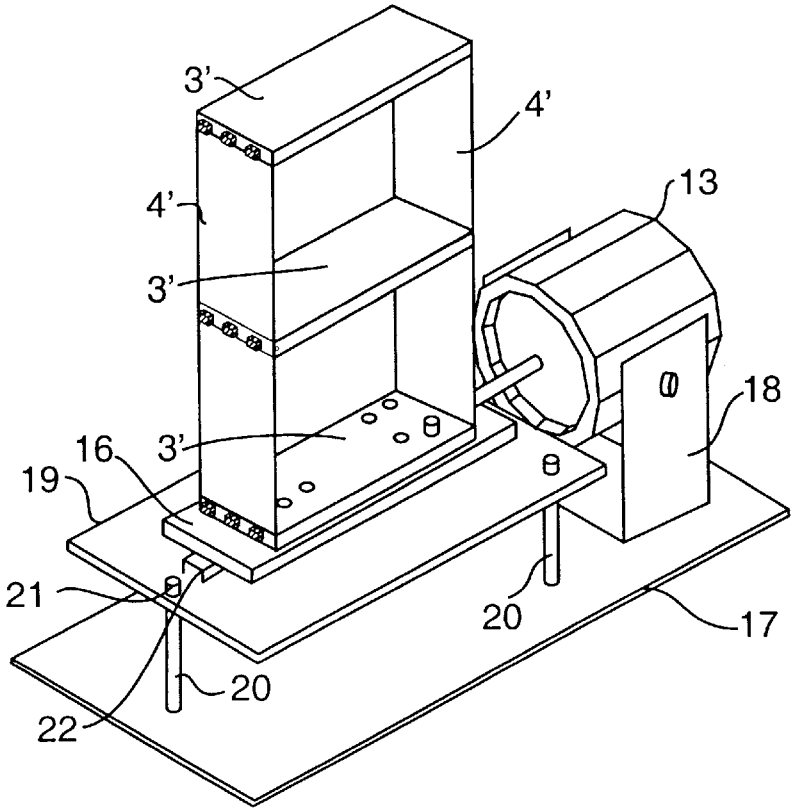
FIG. 9 is an illustration of a system used to test embodiments of the invention.

The final experimental set up is shown in FIG. 9. The model's lightweight construction was ideally suited for the shaker's 13 force output range. Along the same line, the linear slide 22 mounted readily to the bottom of the structure and supported the model's weight easily. The model's base was made significantly larger and heavier than the model, negating any worries about the excitation of the model shaking the experimental platform 19.

In short, the basic structure proved to be an ideal test bed for all aspects of the experimental phase of the project. It was compatible with all experimental equipment and mounting apparatus, allowed for any type of bracing scheme to be applied to its frame and produced an excellent simulation of a typical two-story building.

In order to insure precision results, the base must prevent the introduction of outside vibration into the system. Therefore, the base and all mounting apparatus attached to it must be completely rigid. In addition to rigidity, all components in the experimental system must be perfectly aligned to insure that the output force and displacement of the shaker is what is being induced into the structure.

A 0.250 in. thick piece of structural steel served as the base 17 for the system. It was cut to 1'×2'⅛". A series of holes were machined into the base to accommodate the mounting apparatus which would be fastened to it. The apparatus that was connected to the base consisted of the shaker mount 18 and the model mount 19.

The model mount 19 was also constructed of 0.250 in. thick steel plate, fastened to the base using three threaded 0.250 in. steel rods 20, multiple washers, lock washers and nuts. A four bolt pattern was initially adopted but discarded, because of tremendous amount of difficulty which was encountered during balancing of the plate. The three bolt pattern defined a singular plane and aided tremendously in balancing the mounting plate. The series of nuts and washers used on each bolt assured that the plate would remain perfectly aligned and stationary throughout testing of the structure. Alignment of the model with the shaker was accomplished through the machining of three slots 21 at the mounting bolts. Therefore, the model could be adjusted in the vertical plane by sliding the plate along the mounting bolts and horizontal adjustment satisfied by sliding the plate in the machined slots. Finally, the linear slide 22 was squared up and permanently attached to the steel plate using the factory mounting hardware.

The shaker mount 18 was constructed from 0.0625 in. thick steel plating, cut and formed into a U-shape bracket and anchored to the base using two 0.500 in. bolts. The bracket had two slots machined into its base to allow for adjustment in the horizontal plane and also to adjust against any twist in the shaker bracket. The shaker 13 was mounted to the bracket through two holes machined into the bracket and fastened using the screws supplied by the manufacturer of the shaker.

The connecting apparatus was constructed of aluminum connectors and lexan base plate. The lexan base was attached to the model and served as the connecting plate for all components of the system. The lexan plate was bolted to the slides on the linear rail, the model and also connected to the shaker through a mechanical fuse. The connecting apparatus attaching the shaker to the lexan plate served to fine tune any misalignment in the system through the use of two pin joints and a single slider joint. The slider joint provided any fine tuning of alignment in the horizontal plane, and the pin joints compensated for any vertical misalignment. This coupling system assured that the force of the shaker would be directed along a single axis, insuring precision results from the testing portion of the project.

The mass absorber is the proven means of vibration control used in modern day architecture. In this experiment it will be the standard against which the invention's performance will be gauged. The absorber was designed to prevent resonance and reduce the displacement of the structure at its first natural frequency. By shifting the natural frequencies away from the structure's original natural frequencies.

The vibrational analysis of the three degree of freedom system in MathCad produced favorable results. The fine tuning of the mass and stiffness of the mass absorber successfully prevented resonance and decreased floor displacement at the model's first natural frequency. The values determined in the analytical model showed that the mass absorber could be designed as a simple cantilever beam with a mass suspended at the end of the beam.

The first design iteration employed a cylindrical rod to act as the mass absorber. However, concerns were raised about the beam's motion straying from the axis at which the system is aligned. The final design used a 0.03125 in. thick aluminum plate with two lead weights placed at the end of the beam. The absorber was attached to the top floor of the structure by two aluminum L-brackets. The entire absorber assembly was quite simple to construct and easy to connect and disconnect from the structure with great ease.

Each of the three embodiments herein described was incorporated into the model and tested.

Real time automated computer control of the heating was incorporated. The first step was to experimentally determine the temperature response time of the SMA. The equipment used for this experiment was the Hewlett-Packard 3852A Data Acquisition Control Unit, the Hewlett-Packard 6030A 17A, 1.2 KW, 100V System Power Supply, the Hewlett-Packard 3478A Multimeter, and J-type Thermocouples. All the equipment used was first tested and calibrated. Although T-type thermocouples were originally selected for experimentation because of their accuracy at low working temperatures, J-type thermocouples were eventually chosen for signal conditioner compatibility. The Data Acquisition Unit was operated manually and temperature observations were taken every five seconds. Six runs were taken of every setup in order to have small 95% confidence intervals. The Thermocouples were attached to the Data Acquisition machine to monitor the temperature of the SMA for the initial experiments. The thermocouples were attached to the SMA by using heat resistant glue. Plastic heat shrink tubing was applied to the Nitinol strips to electrically insulate the Nitinol strips and to reduce the interaction with air. The power supply was then attached to opposite ends of the SMA with clips. A multimeter in voltmeter setting was attached to the SMA in parallel in order to measure the resistance response while different currents were sent threw the SMA strip.

50° is the austenite start temperature for the SMA and 74° is the austenite finish temperature. This corresponded to 25 and 65 seconds, respectively. Actual recovery of the SMA was observed at around 62°.

This setup provided accurate results for the first type of SMA used, bought from Shape Memory Application Inc., which reached austenite finish in 1.75 minutes. The second batch of SMA was acquired from Memory Corporation. This SMA had three times the resistance and responded in 5–10s this required equipment that read data continuously. Therefore, the Hewlett-Packard oscilloscope model number 54501A 100 MHz was to measure the thermocouple voltage. The thermocouple voltage was run through a 5B37-J signal conditioner from Analog devices that amplified the voltage to 0 to +5V. This was used for cold junction compensation, and reduced noise.

Once the electrical characteristics and response characteristics of the material were known, the circuits for the different bracing systems were developed. All the elements were connected in series to ensure uniform current in all members and, with all elements in a specific setup being almost identical in resistance, uniform heat generation. The power supply was first programmed by switching jumpers and attaching cables to the screws on the back panel. The cables were connected to the connector block where a 0 to +5V analog signal was received from the computer. This voltage controlled the output current according to:

$$I_{out}=(17A/5V)V_{in}$$

However, a limiting circuit voltage drop can be set on the front panel of the power supply so that even at maximum input voltage the current will not exceed the current corresponding to the limit voltage. The National instruments hardware was used for the data acquisition system.

Five different setups were used, but only three required activation.

1. Eight pistons were connected in series in a X-bracing configuration. The connections were soldered together. 4.2 amps were supplied since, according to the piston's manufacturer, the pistons take a typical 4.0 amps and a maximum 5.0 amps. The manufacturer provided response characteristics. It took 2.5 seconds to start contracting when the piston was actuated at 4.0 Amps in 21 degrees Celsius still air. It took 6.0 seconds to complete 90 percent of its actuation. After deactivation of the pistons that were activated for 10 minutes, the relaxation response time took 3.0 seconds to start and 7.0 seconds to become 90 percent complete.

2. V bracing using pistons: This used the same pistons as X-bracing and is described as follows.

3. Inverted Y-bracing: Memory Co. SMA strips perpendicular to the models floors were used. SMA strips 2½ inches in length were sandwiched between LEXAN bars and connected in series electrically through copper inlays. These strips were insulated with shrink tubing. 8A DC were used for activation. A diagram of this set up can be seen in the model description portion.

Setup #3 used the thermocouple feedback while the setups with the pistons simply used a time delay supplied by the manufacturer for activation control.

In this investigation, these two features, frequency and ground displacement, were to be provided and controlled by the Earthquake Data Group. This group was responsible for providing all shaker programs necessary to induce building's base excitation. In addition, the group was responsible for the shaker system setup and operation during experimentation.

The objective of the Earthquake Data Group was to displace the base of a building's model in two separate ways: sinusoidal displacement and earthquake displacement. The earthquake displacements were generated using data obtained from El Centro Earthquake at California. This group generated and sent the signal to a shaker. The shaker is the device used to excite the building model. Computer using Lab View software controlled the sinusoidal displacement and earthquake displacement.

The Lab View program for the earthquake data used a program code that read lines and columns saved in an ASCII format. The earthquake data obtained at El Centro in California was written and saved in an ASCII format. The data was in acceleration versus time format. ASCII format enabled the user to access the data through an array, which was used to graph the data. Then, the graph signal changed to a random voltage signal and store in a one-dimensional array by the AO (analog output) Generate Waveform icon.

The voltage signal traveled out of the computer to other system connectors by the device and channel available of the Data acquisition Card. Device one and channel zero were used during this experimentation. The voltage signal reached the shaker and displaced the building.

The vibration testing was divided into three main groups: free vibration, forced sinusoidal vibration and earthquake simulation. These tests were designed to compare the performance of Nitinol bracing with the performance of a mass absorber.

Once design and construction of the model and Nitinol Bracings were completed, testing began. First, it was verified that the structure's natural frequencies were in the range of the design criteria. This was accomplished by performing a free vibration test on the structure. After the natural frequency of the structure was obtained, it was necessary to measure floor displacement to determine percent reduction.

Each bracing was incorporated into the experimental system and its performance under the influence of a force applied to the base was measured. Difficulties were encountered in displacing the base at the natural frequencies of the structure. The structure would shake violently, as expected, but the displacement of the base of the structure would no longer be a sine wave even though the right signal for a sine wave was being sent to the shaker. Also a desired peak to peak displacement of 4 mm could not be obtained. Apparently, there were feedback movements from the structure to the shaker, strong enough to prevent the shaker from providing the appropriate base displacement. So we decided to measure the displacement of the structure's floors at 0.5 and 0.75 Hertz below and above the natural frequency, in compliance with the objective of subjecting the structure to the different modes of vibration, and maintaining a sinusoidal base excitation.

The model was subjected to free vibration with the purpose of obtaining the natural frequencies of the structure. This was done for the basic model, the model with different Nitinol Bracings, and the model with the mass absorber attached. The purpose of finding the natural frequencies of the basic model and the model with the different bracings was to prove that the bracings worked as was proposed in the design. The bracings were not to affect the natural frequency and behavior of the building when the SMA was not activated.

Figure 10:
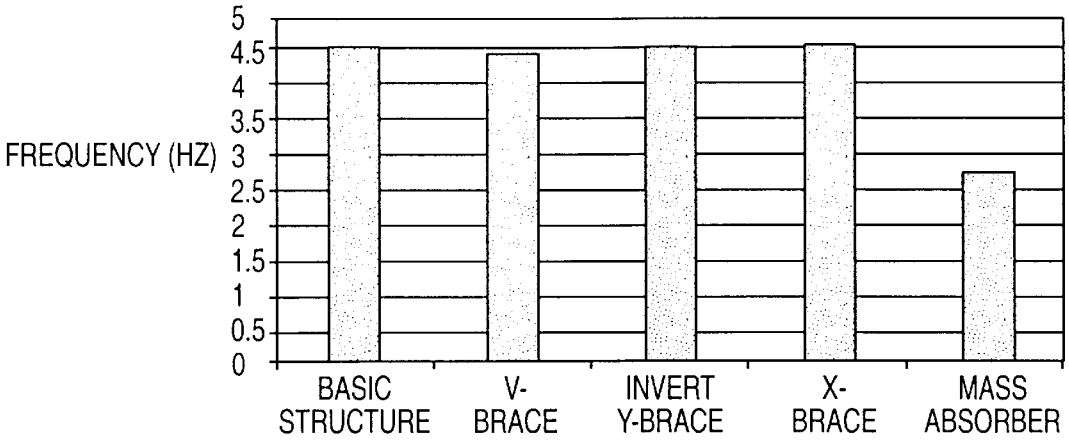
FIG. 10 is graph showing the first natural frequencies of structures in which embodiments of the invention are placed.

FIG. 10 shows the first half of the results of the Free Vibration tests. Here it is shown the first natural frequency of the basic structure, the structure with the different bracing systems, and structure with mass absorber. As can be seen, the members of the invention did not significantly affect the first natural frequency of the building when they were not activated. In contrast the mass absorber shifted the natural frequency downward, making the building more vulnerable to low frequency earthquakes.

Figure 11:
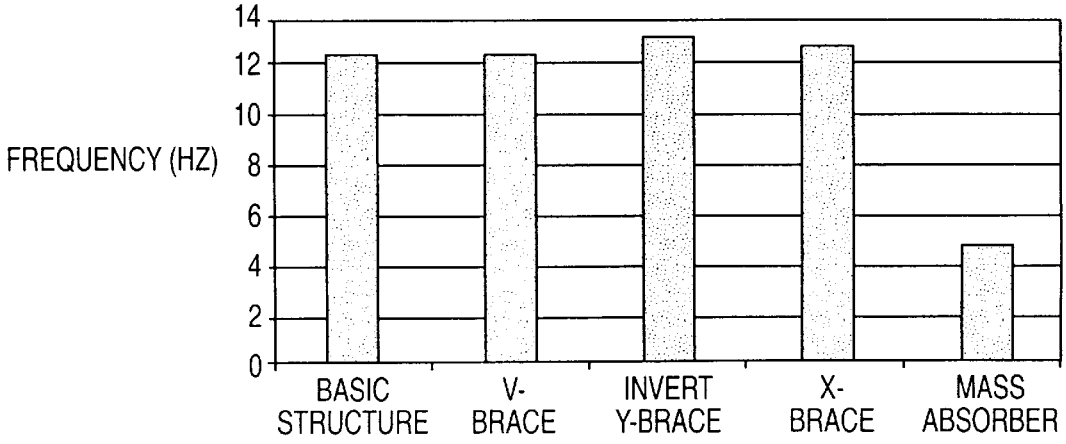
FIG. 11 is graph showing the second natural frequencies of structures in which embodiments of the invention are placed.

FIG. 11 shows the second half of the results of the Free Vibration tests. It is shown here the second natural frequency of the basic structure, the structure with different bracing systems, and the structure with mass absorber.

It was concluded that the changes in the first natural frequencies were minimal with the addition of the different bracing systems. V-Bracing reduced the natural frequency by 3.6%, for the inverted Y-Brace 1.3%, and for the X-brace 3.95%. The different bracings were not to affect the natural frequency and behavior of the building when not activated, and this goal was met. This graph was used to select the range of frequencies at which the structure was excited.

In the sinusoidal base excitation experiment, the model was subjected to a sinusoidal base excitation of 4 mm, at frequencies just above and below the natural frequencies of the structure, where the peak to peak displacements of each floor were measured. The criteria to chose the frequencies that were tested was described with reference to FIGS. 10 and 11. This process was repeated for the model with different Nitinol Bracings as well as the model with the Mass Absorber attached.

The mass absorber was manufactured as a proven vibration control device to serve as a control to compare the performance of the SMA bracing. After it was attached to the structure, and the sinusoidal force setup was finished, the data gathering began. The base displacement for all frequencies was fixed to 4 mm from maximum to minimum. The response of each floor to the base input was measured at eight different frequencies, two below and two over each of the natural frequencies of the basic structure. The absolute displacements of each floor, with respect to the ground, from maximum to minimum was measured and compared with the displacements of the structure without the absorber.

Figure 12:
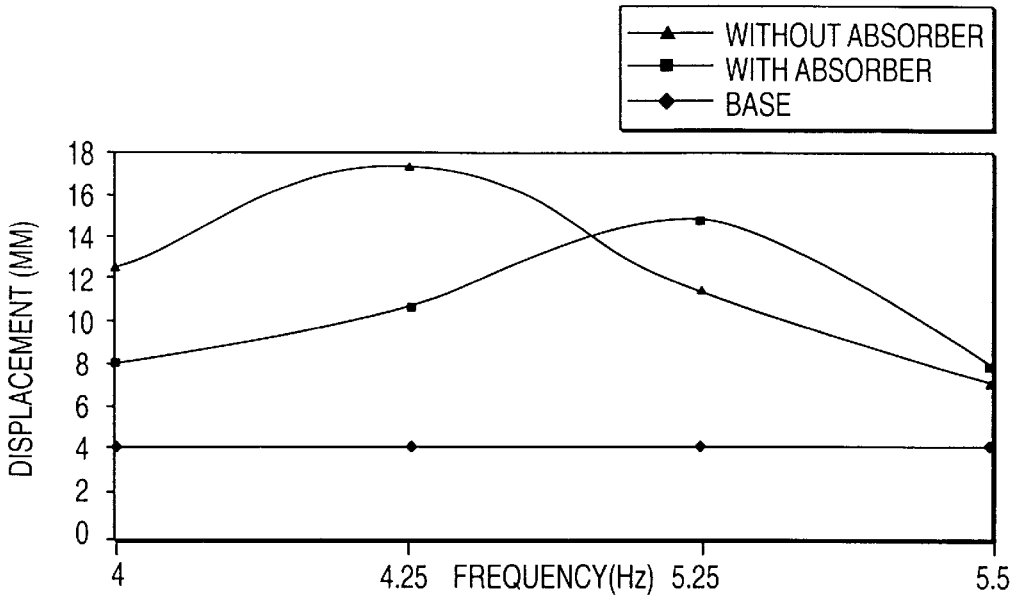
FIGS. 12–15 are graphs showing the influence of a mass absorber on a the vibration response of a structure.

In the neighborhood of the first natural frequency (FIG. 12), the absorber decreased the absolute displacement of the first floor by 37% of the absolute displacements without the absorber, at frequencies below 4.56 which was the first natural frequency of the basic structure. Above these frequencies the absorber increased the displacements.

Figure 15:
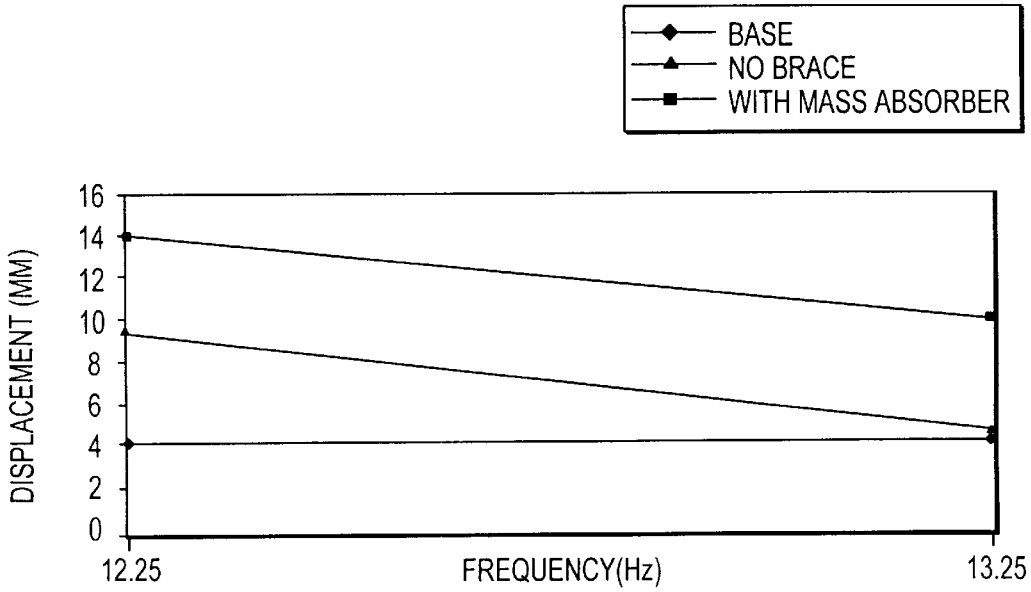

With the mass absorber four frequencies were taken in the neighborhood of the second natural frequency of the basic structure. But it was not possible to obtain data at exactly the same frequencies for the structure without the mass absorber. For these reasons, FIGS. 13 and 15 have only two points to compare, one lower than the second natural frequency of the basic structure and one higher.

Figure 13:
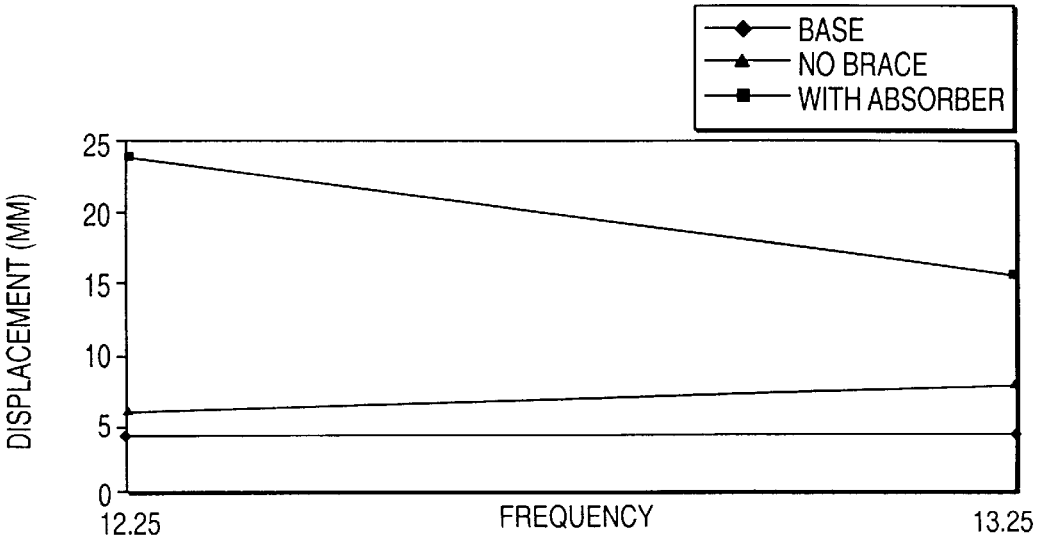

As can be seen from FIG. 13, the displacements of the first floor at all frequencies near the second natural frequency were increased. For the first floor the mass absorber work as expected since it was designed to reduce the displacement at the first natural frequency.

Figure 14:
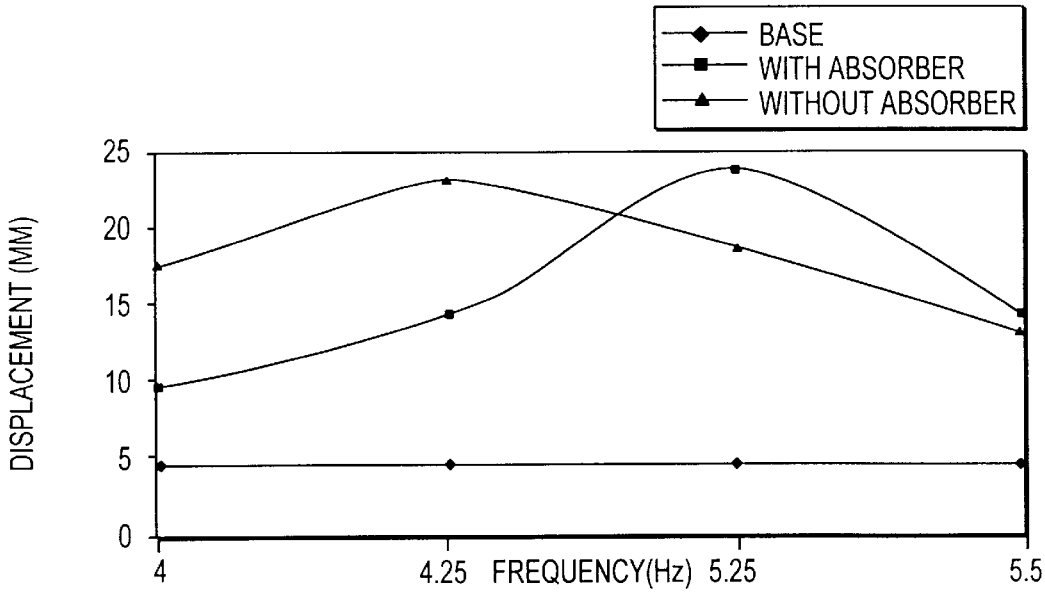

The same procedure used to obtain the data for the first floor with mass absorber was performed to obtain the data for the second floor. For frequencies lower than the first natural frequency the mass absorber decreased the absolute displacements of the second floor by 42–46%. As it can be seen on FIG. 14 for frequencies above the first natural frequency the displacement was increased due to the utilization of the mass absorber.

A similar behavior was observed for the second floor. At the neighborhood of the second natural frequency it increased the displacement as demonstrated in FIG. 15.

An X-Brace made of Nitinol pistons was the first SMA bracing that was tested. As for the testing of the mass absorber, eight frequencies were tested at a base excitation of 4 mm from maximum to minimum. Four frequencies in the neighborhood of the first natural frequency and four in the neighborhood of the second natural frequency were tested.

Figure 16:
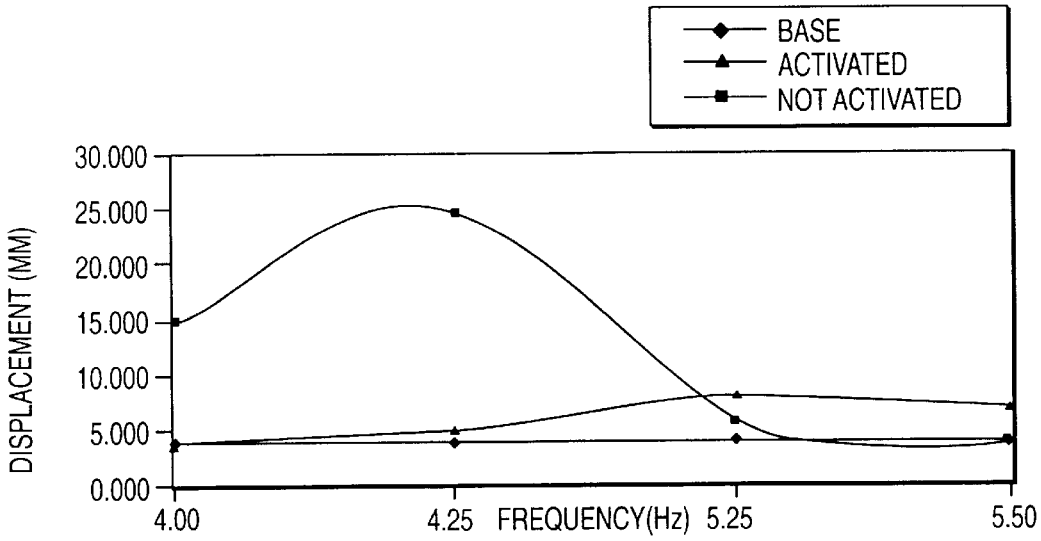
FIGS. 16–19 are graphs showing the influence of the first embodiment on a the vibration response of a structure.

In the following figures the absolute displacements of the floors (maximum absolute minus minimum absolute displacement) with the pistons of the X-brace activated is compared with the displacement of the floors with the pistons not activated. FIG. 16 compares the displacements of the first floor excited at frequencies near the first natural frequency. The X-brace decreased the absolute displacements of the structure's first floor by near 78% when the pistons were activated. It can be seen from FIG. 16 that at the two frequencies higher than the critical, the activated brace increased the displacements of the floors. But it should be noted that the absorber increased the displacement by near 225% and the activated pistons X-brace only increased the displacement around 64%.

Figure 17:
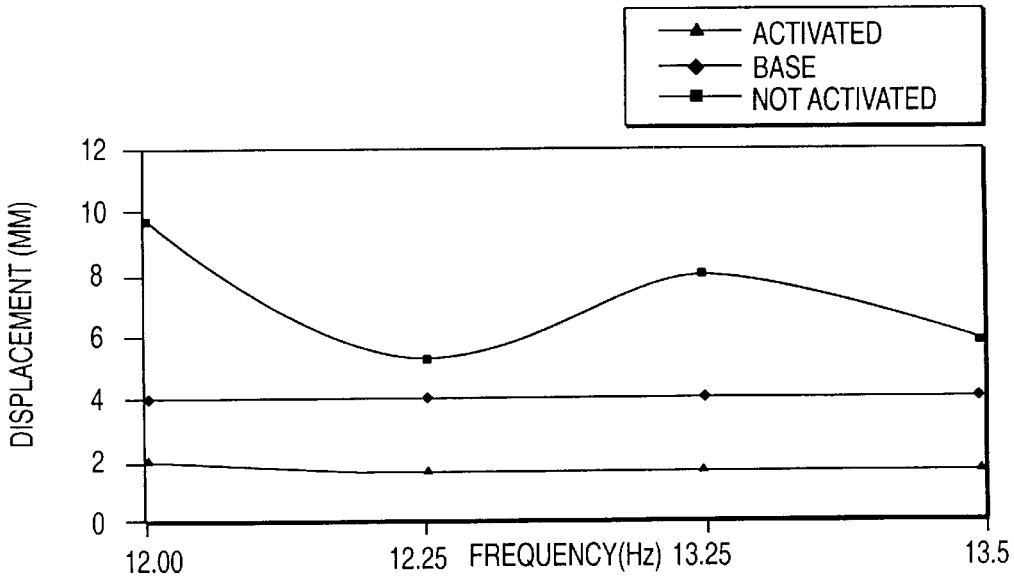

FIG. 17 shows the reduction in absolute displacement of the first floor when excited at frequencies near the second natural frequency. The activated X-brace reduced the displacement of the floor by near 73%.

Figure 18:
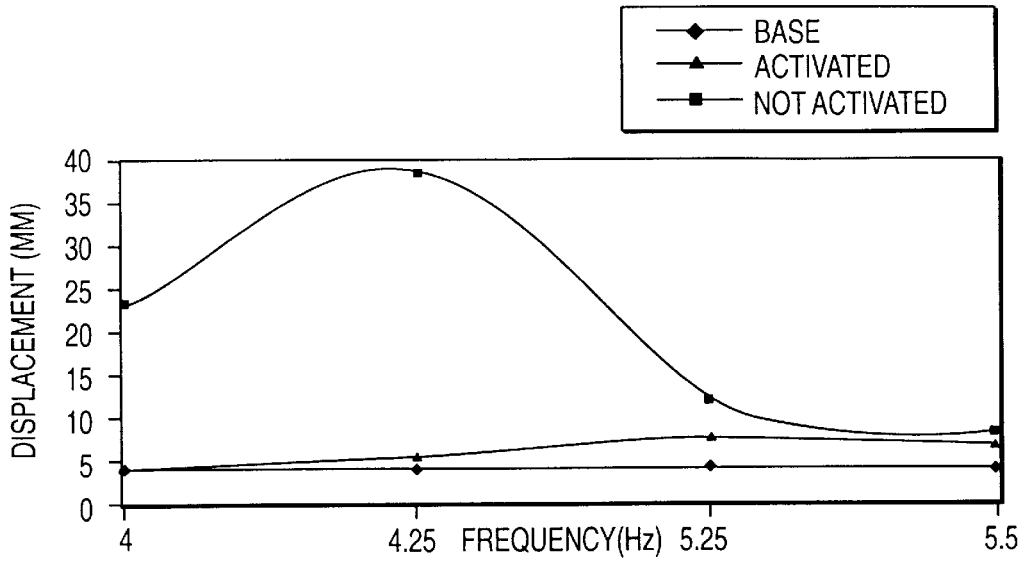

As shown in FIG. 18, the absolute displacements of the second floor for the structure with the X-brace pistons activated and not activated. The frequencies at which they were excited were in the neighborhood of the first natural frequency. When the pistons were activated the absolute displacement was reduced by nearly 53% from the displacement of the structure with the pistons not activated.

Figure 19:
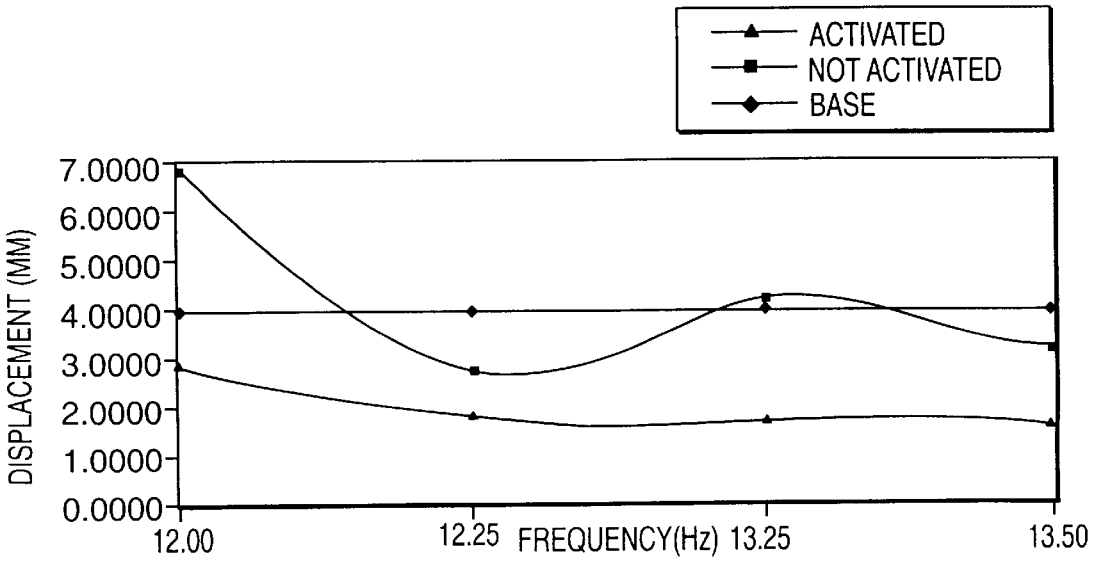

In FIG. 19, it is shown the same comparison of the displacements of the second floor but under the excitation of frequencies near the second natural frequency. The activated X-brace reduced the displacement by nearly 47% from the displacement of the structure with the pistons not activated. These reductions could actually be seen when the pistons were activated. The structure looked like a rigid body.

Figure 20:
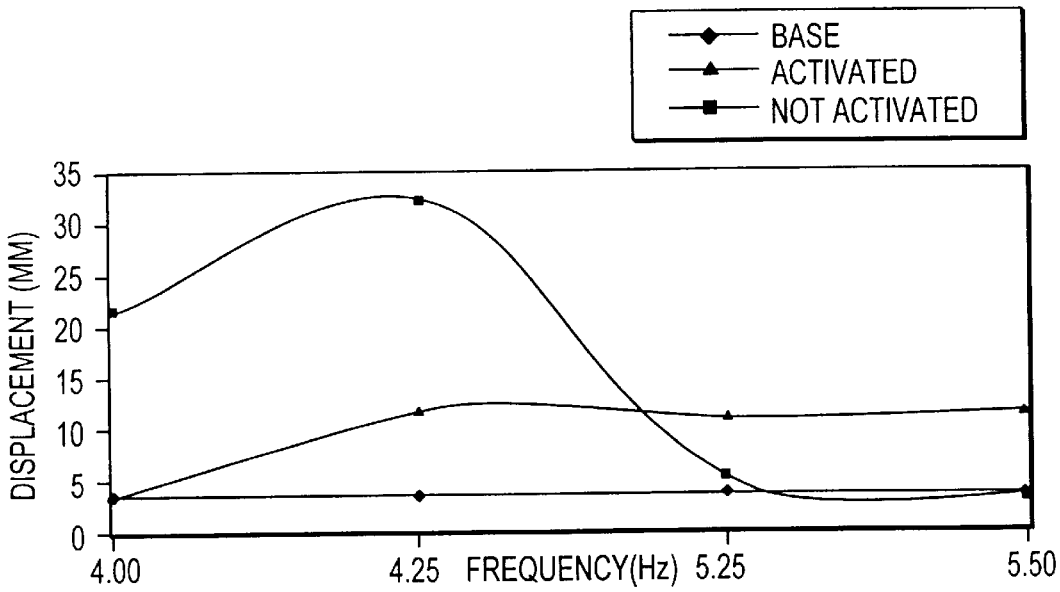
FIGS. 20–23 are graphs showing the influence of the second embodiment on a the vibration response of a structure.

The procedure and setup for the V-shaped brace was the same as for the X-brace testing. FIG. 20 shows the absolute displacements of the first floor with the structure excited at frequencies around the first natural frequency. The displacements were measured from the maximum to the minimum displacements at each frequency. As the figure shows, the displacement of the base is four millimeters as for all the other tests. It can be seen that at frequencies lower than the first natural frequency the absolute displacements of this floor were reduced with the activation of the SMA pistons. At these lower frequencies the amplitudes were reduced by nearly 69% of the displacements with the pistons of the V-brace not activated. But at the two higher frequencies tested the displacements were increased by approximately 140%.

Figure 21:
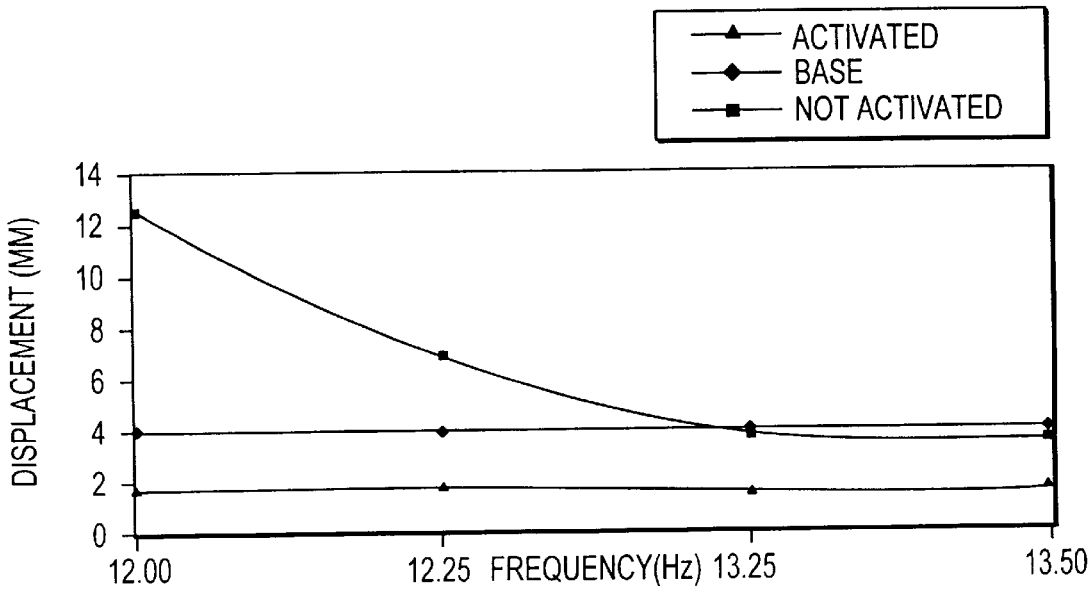

At higher frequencies near the second natural frequencies the activated V-brace had better results for the first floor. As can be seen on FIG. 21, it reduced the displacements of this floor to less than the base excitation. The floor moved around 1.5 millimeters. At the two frequencies lower than the second natural frequency the displacements were reduced by nearly 80% and 63% for the two higher frequencies tested.

Figure 22:
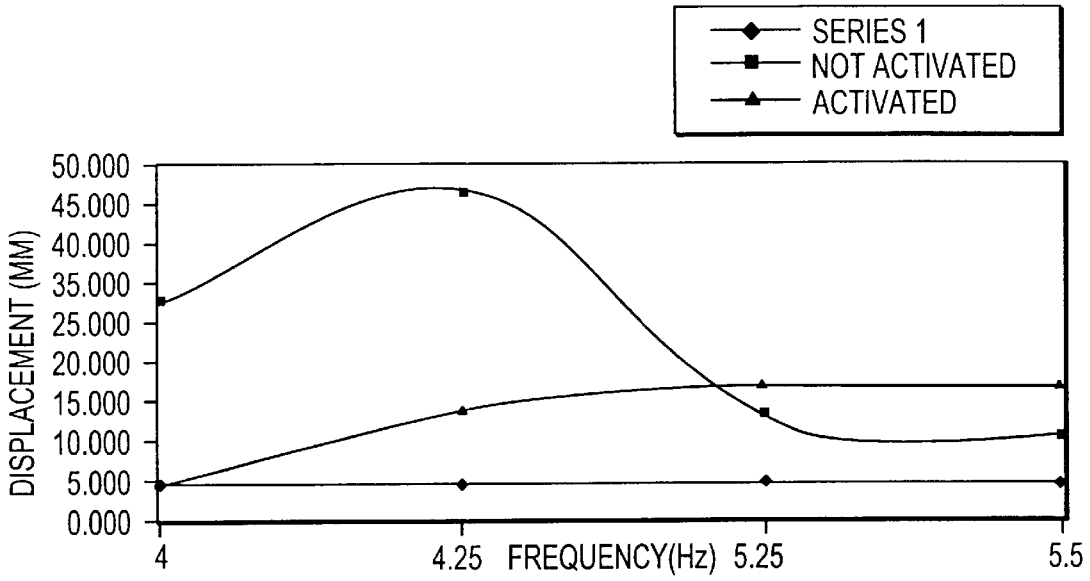
Figure 23:
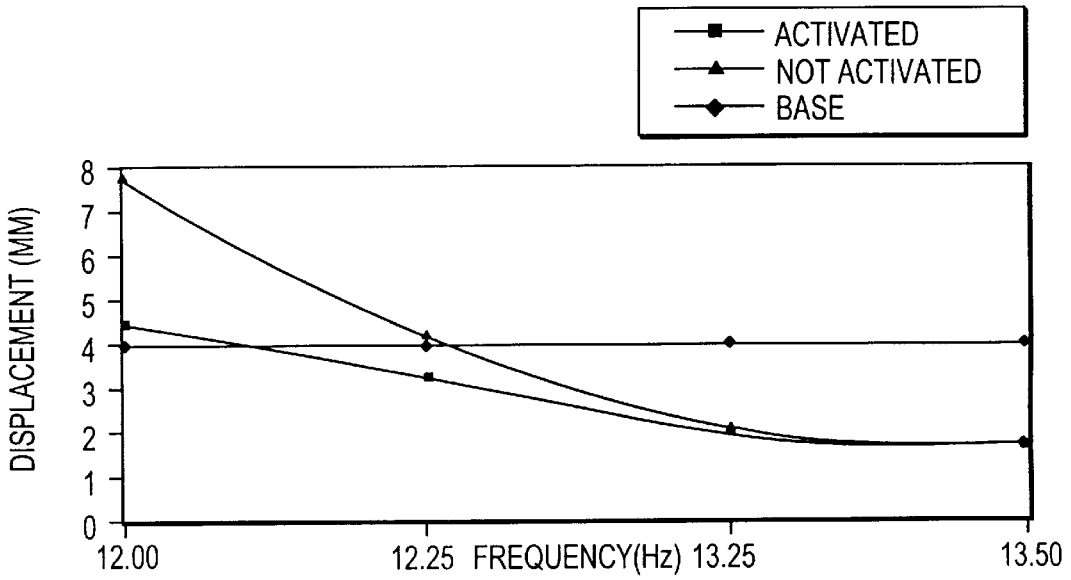

For the second floor the V-bracing had a behavior similar to the first floor. As can be seen on FIG. 22, when the structure was excited at frequencies lower than the first natural frequency the displacements were reduced and at higher frequencies it increased them. At the two lower frequencies the displacements were reduced by nearly 78% while at the two higher frequencies the displacements were increased by around 60%. As can be seen on FIG. 23, at the four frequencies that were tested close to the second natural frequency the displacements were reduced. At the two frequencies tested lower than the second natural frequency, the displacements were reduced by near 32% and at the higher frequencies, the displacements were reduced by 4%.

The same sinusoidal test was performed for the inverted Y-Bracing. As described previously the heating of the SMA strips was done by sending current through the strips. Two strips of the bracing were connected to the power supply. A computer program controlled the current that was send through the SMA strips. A thermocouple was attached to the bracing to monitor the temperatures reached by the SMA strips when they were heated.

Figure 24:
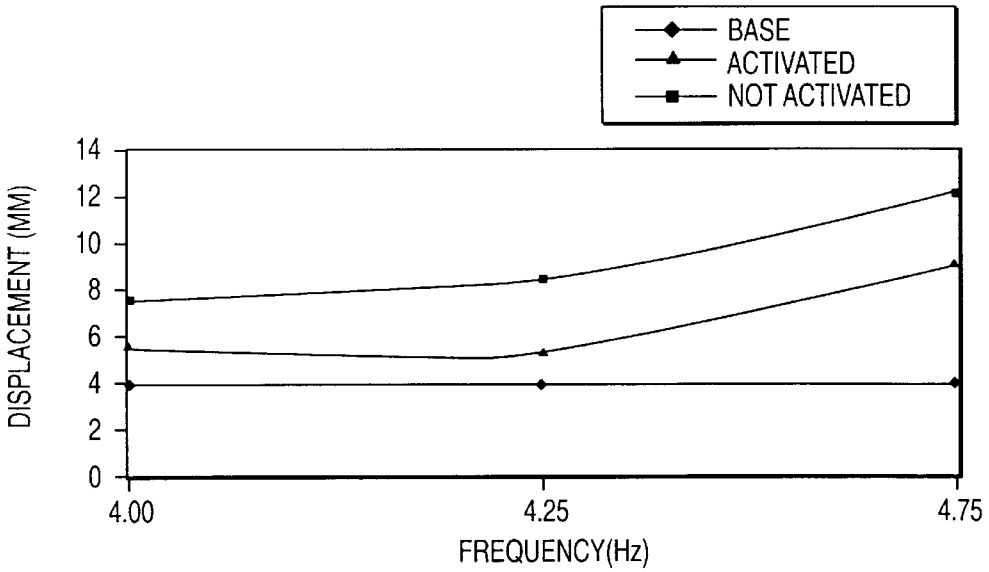
FIGS. 24–27 are graphs showing the influence of the second embodiment on a the vibration response of a structure.

In the procedure, the absolute base displacement was fixed to 4 mm. The displacement of each floor with the braces activated was compared to the displacements with the braces not activated. The displacements were measured from the maximum to the minimum movement of each floor. FIG. 24 shows the displacements of the first floor at frequencies near the first natural frequencies. The criterion to choose these frequencies was described previously with reference to FIGS. 10 and 11. As can be seen on FIG. 24, there are only three frequencies compared. The reason is that it was not possible to displace the base 4 mm at the missing frequency. From the figure the reader can appreciate that the displacements of the first floor were reduced with the activation of the SMA strips. There was a reduction in displacements of approximately 30% when the SMA was activated.

Figure 25:
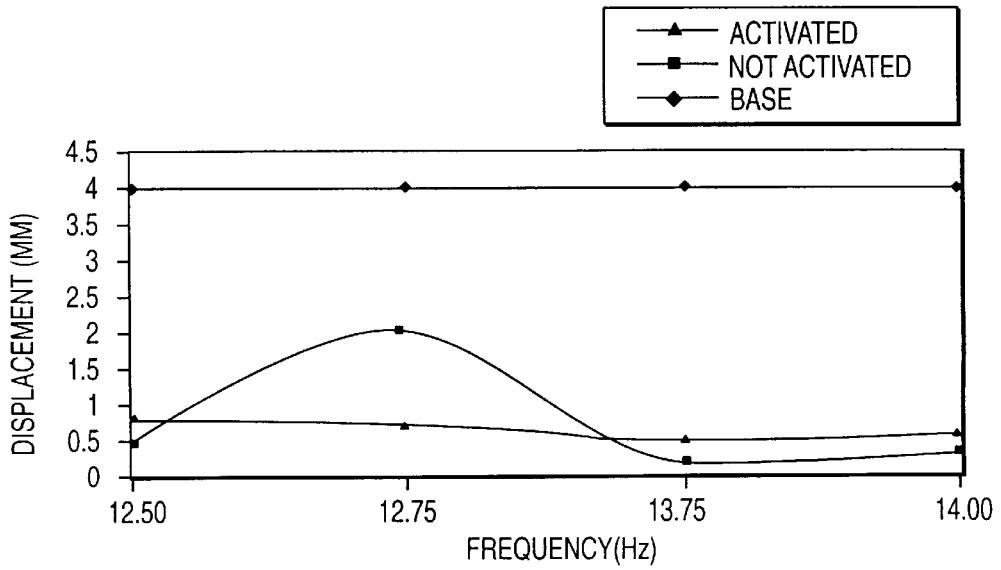

In FIG. 25 it can be seen the behavior of the first floor at frequencies in the neighborhood of the second natural frequency. At these frequencies the displacements of this floor were smaller than the base excitation. When the SMA strips were activated the displacements were reduced to less than a millimeter. To the naked eye it appeared as if it was not moving at all.

Figure 26:
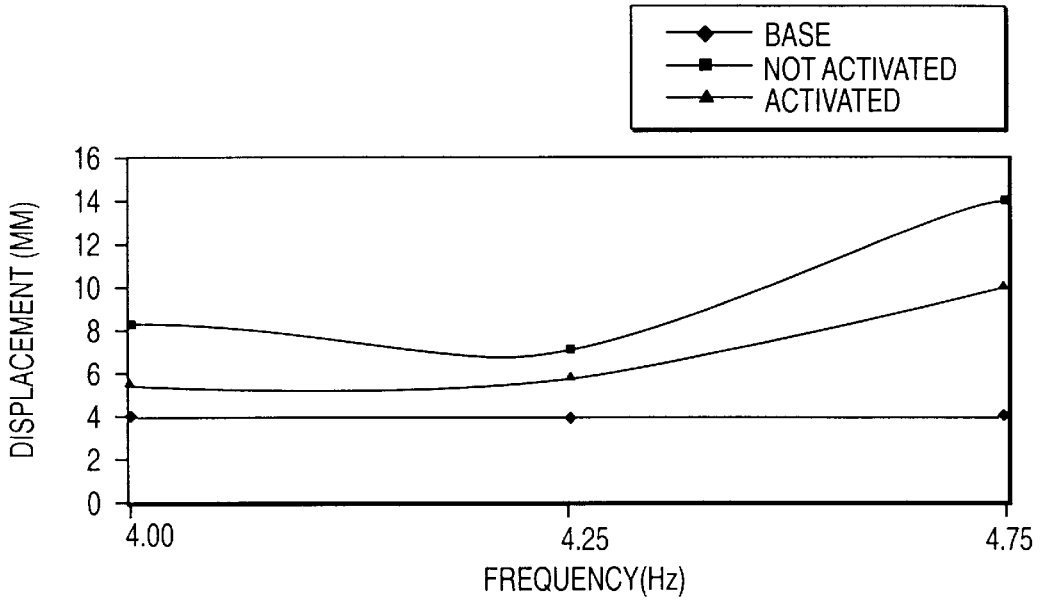

For the same reasons explained previously, only 3 frequencies were compared in FIG. 26. As can be seen on the figure, at all frequencies the displacements are reduced. At these frequencies the inverted Y-brace reduced the displacements of the second floor by nearly 26%.

Figure 27:
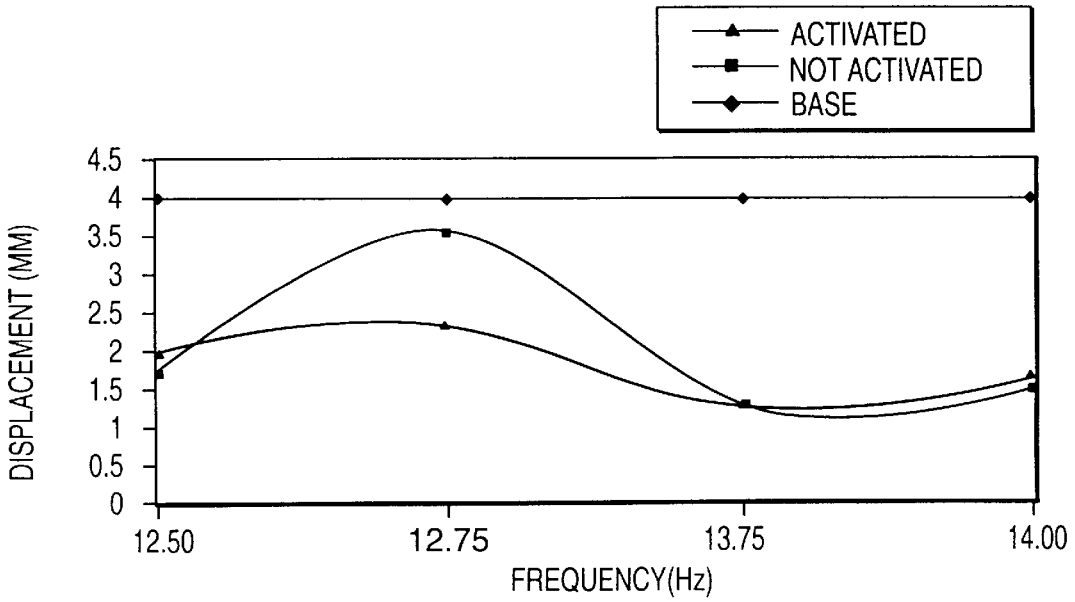

For the frequencies in the neighborhood of the second natural frequency, the displacements of the second floor stayed close to two millimeters. As can be seen on FIG. 27, these displacements are smaller than the base excitation. When the strips were activated, the displacements of the second floor were actually increased at the frequencies that had produced displacements less than two millimeters when the strips were not activated. But at the frequency that the displacement was more than two millimeters it decreased the displacement by nearly 36%.

Figure 28:
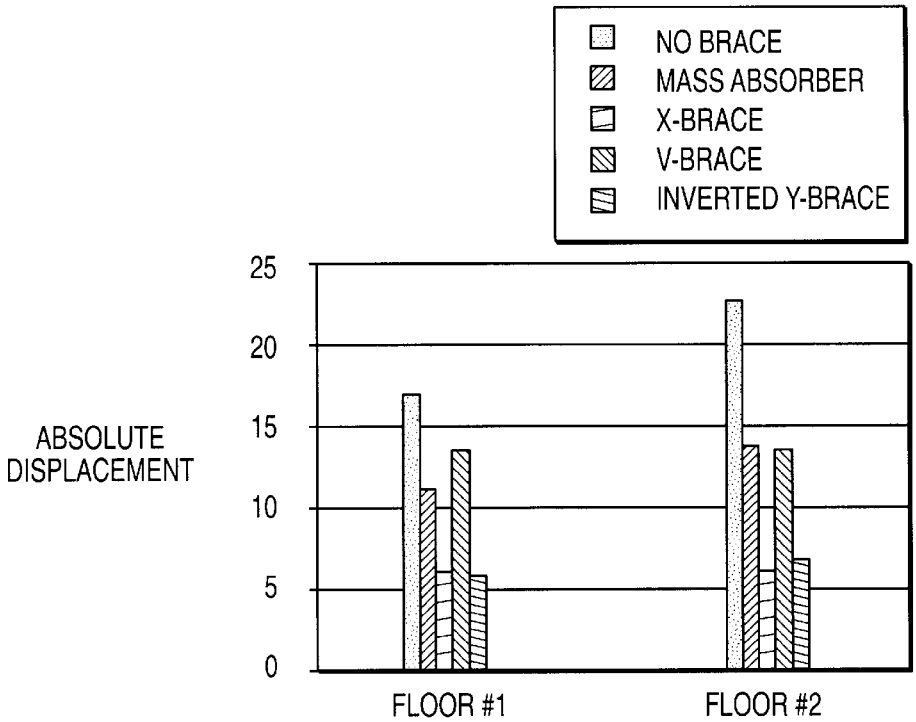
FIG. 28 compares the absolute peak to peak displacements of an unbraced structure, a structure with a mass absorber and structures incorporating the embodiments of the invention under sinusoidal excitation.

FIG. 28 compares the absolute peak to peak displacements of each floor of the model with no bracings, model with mass absorber, and model with different Nitinol bracings. The displacement of floor #1 of the structure with no bracings was about 17 mm, but with the addition of the mass absorber this absolute displacement diminished about ⅓. As with the mass absorber, the Nitinol Bracings diminished the absolute displacement of the structure, some more than others. All the bracings, except one, diminished displacement better than the mass absorber. The V-Bracing did not do better than the mass absorber, but it's performance was comparable. The structures with the X-Brace and the Inverted Y-Brace, showed the smallest displacement of all, just above 5 mm.

The measurements taken on floor #2 display a very similar behavior to those of floor #1. The only difference lies in the fact that all the measurements are larger.

The next experiment done was subjecting the structure to an erratic base excitation, simulating the effects of an earthquake. In this experiment, as in the one before, an erratic signal was fed to the shaker, and this, in turn, displaced the base of the model in an erratic fashion. The purpose of this experiment was to measure the performance of the bracings, as opposed to the mass absorber's, in reducing displacement of the model's floors, when the structure was vibrating under earthquake conditions.

Figure 29:
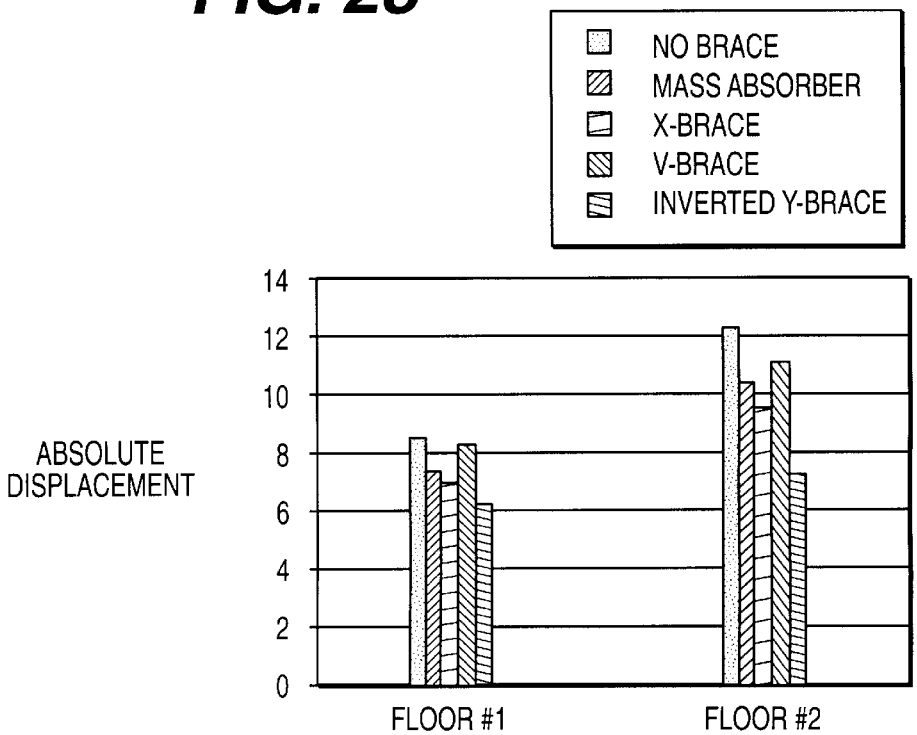
FIGS. 29 compares the absolute peak to peak displacements of an unbraced structure, a structure with a mass absorber and structures incorporating the embodiments of the invention under erratic excitation.

In FIG. 29, the absolute displacement (measurement taken from the peak to peak amplitude of displacement of the structure) of each floor of the model with no bracings, model with mass absorber, and model with different Nitinol bracings, under the effects of an erratic excitation, just like that of an earthquake can be observed. The displacement of floor #1 of the structure with no bracings, was about 9 mm, but with the addition of the mass absorber, this absolute displacement diminished about ⅙. As with the mass absorber, the Nitinol Bracings diminished the absolute displacement of the structure, some more than others. Basically, the behavior of the different bracings and the mass absorber were the same, when compared one with the other, but the overall performance of the different bracings and mass absorber was not as drastic as with the sinusoidal base excitation.

Figure 30:
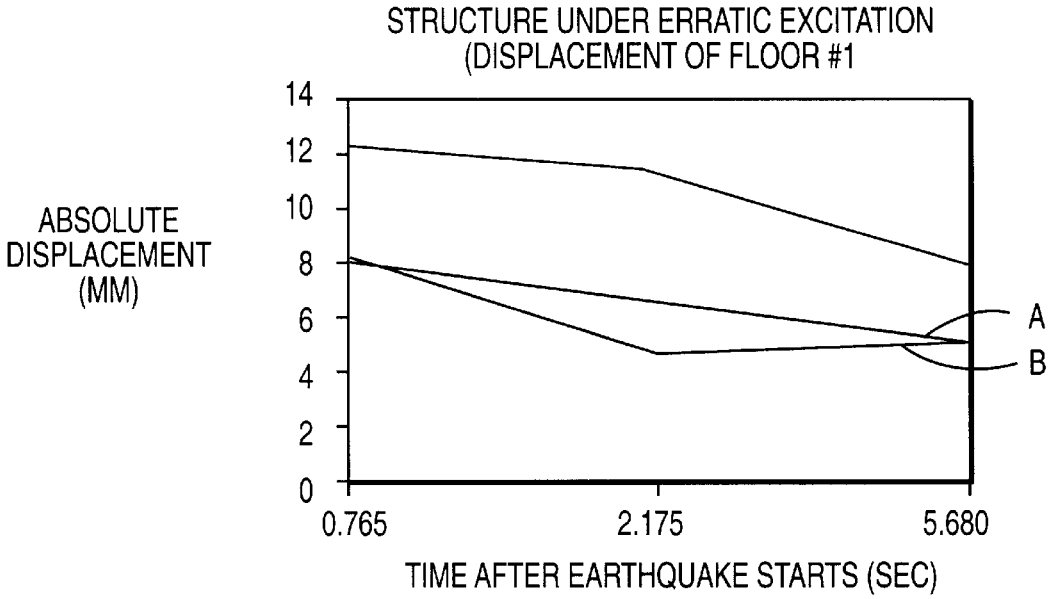
FIG. 30 compares the absolute peak to peak displacements of the first floor of a structure under conditions in which the bracing system of the first embodiment is unactivated and activated under erratic excitation.
Figure 31:
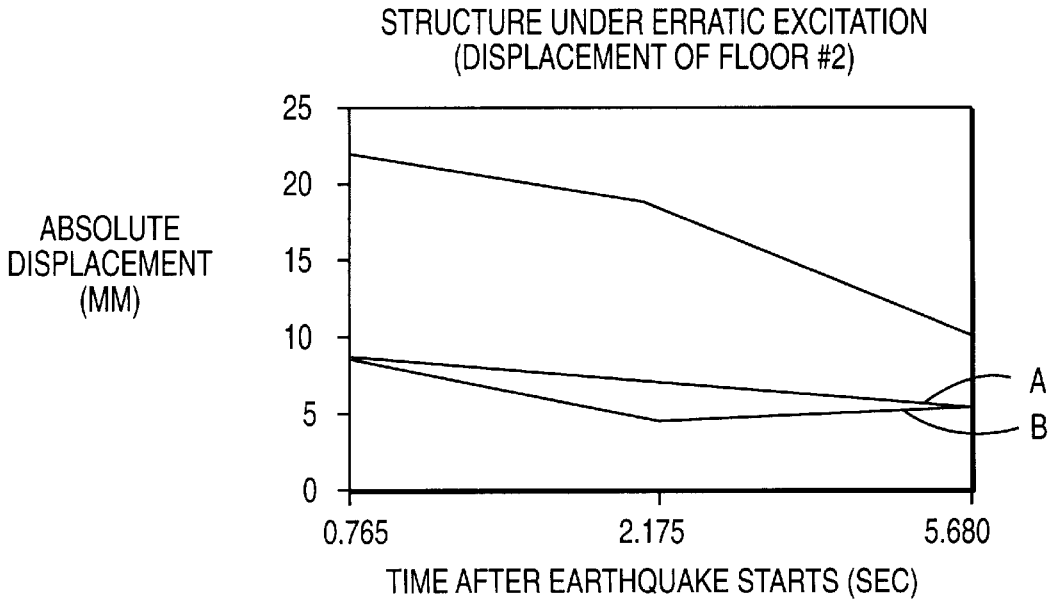
FIG. 31 compares the absolute peak to peak displacements of the second floor of a structure under conditions in which the bracing system of the first embodiment is unactivated and activated under erratic excitation.

Observation of the graphs of FIGS. 30 (Displacement of Floor #1) and 31 (Displacement of Floor #2) reveals the marked decrease in absolute displacement of the first floor, after activation of the X-brace system (Line A), under earthquake conditions. The first floor's displacement is almost the same as the base displacement (Line B), revealing almost no relative displacement with respect to the base.

Figure 32:
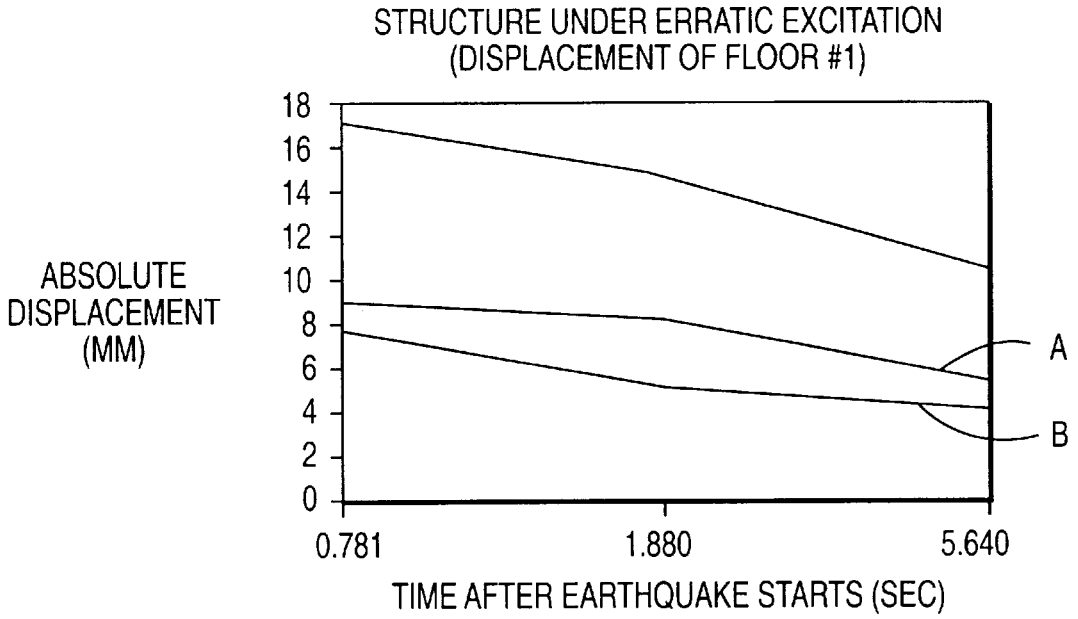
FIG. 32 compares the absolute peak to peak displacements of the first floor of a structure under conditions in which the bracing system of the second embodiment is unactivated and activated under erratic excitation.
Figure 33:
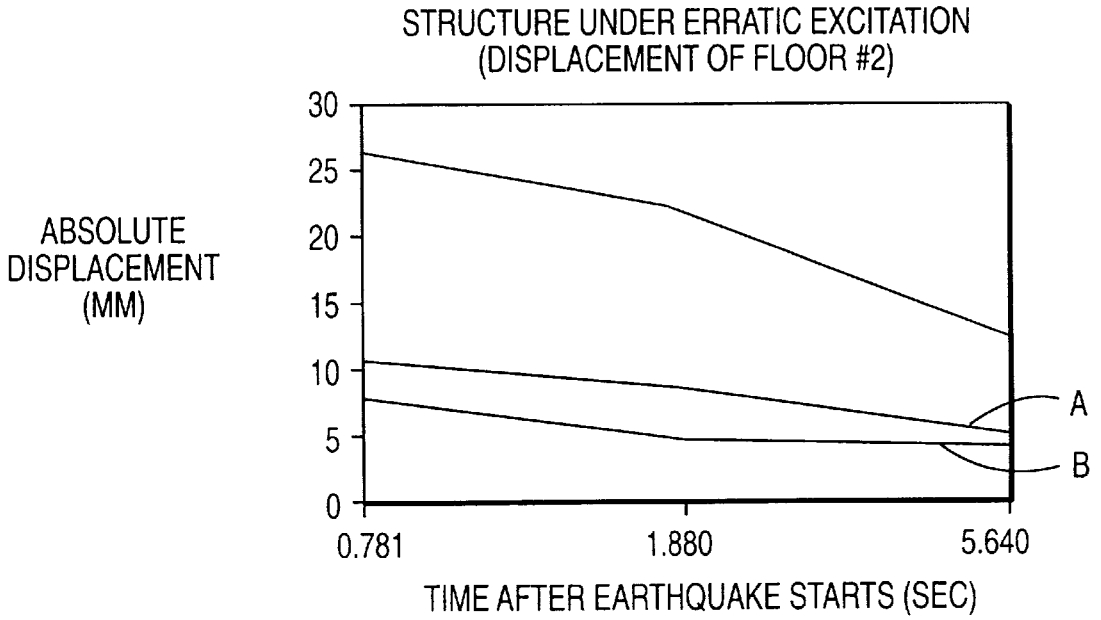
FIG. 33 compares the absolute peak to peak displacements of the second floor of a structure under conditions in which the bracing system of the second embodiment is unactivated and activated under erratic excitation.

FIG. 32 illustrates a sharp decrease in displacement of the first floor once the SMA in the V-Brace system is activated. This decrease brings the displacement of floor 1 to be almost identical to the base displacement. This behavior also applies to the second floor of the structure (See FIG. 33).

Figure 34:
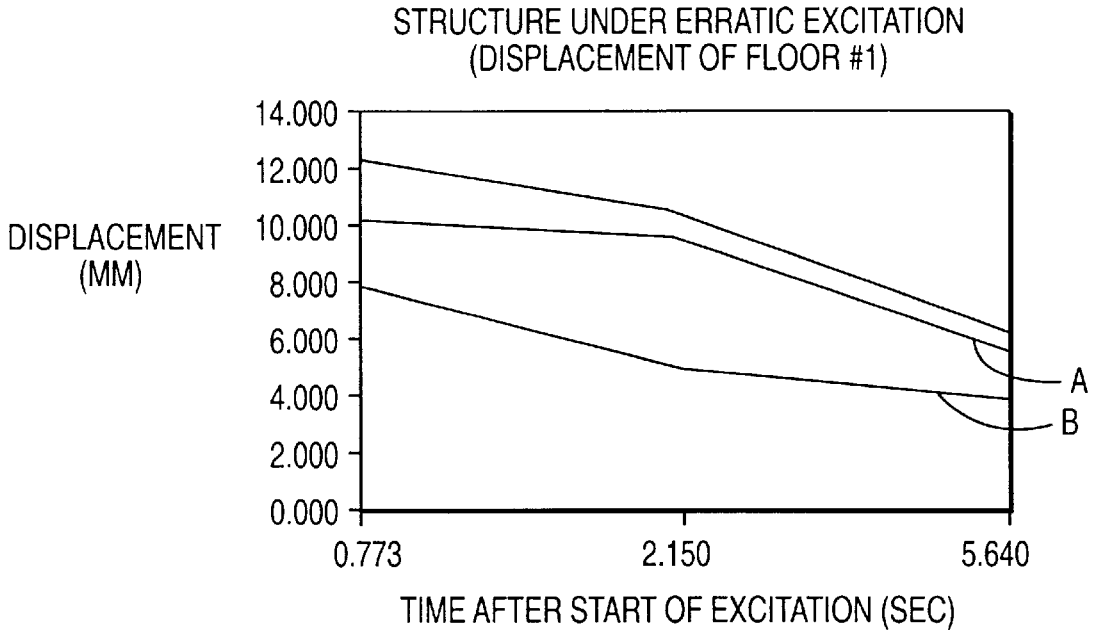
FIG. 34 compares the absolute peak to peak displacements of the first floor of a structure under conditions in which the bracing system of the third embodiment is unactivated and activated under erratic excitation.
Figure 35:
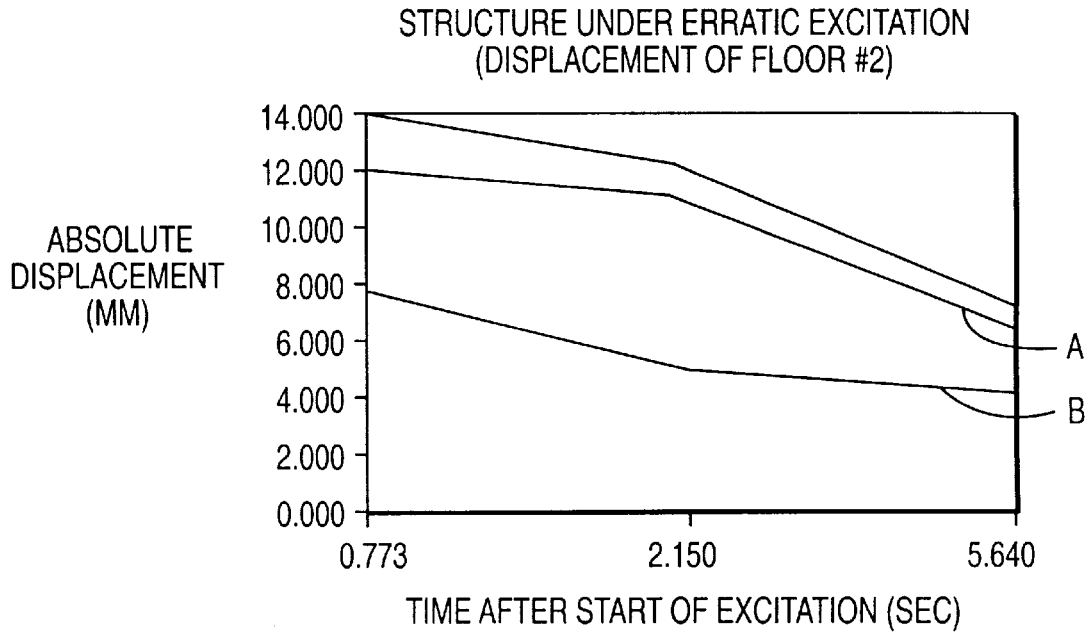
FIG. 35 compares the absolute peak to peak displacements of the second floor of a structure under conditions in which the bracing system of the third embodiment is unactivated and activated under erratic excitation.

Compared with the other bracings, the least effective one with respect to reduction of displacement under earthquake conditions, is the Inverted Y-Brace (see FIGS. 34 (first floor) and 35 (second floor)). But this does not mean it's the one bracing of least importance. In this bracing, we can observe the Nitinol's effectiveness, thanks to the bracings configuration, and geometry. Any percent reduction in displacement is due directly to a change in the stiffness of the material under bending.

Although not illustrated here, a structure with mass absorber suffers higher displacement than a structure without a mass absorber. As opposed to what would be desirable, the mass absorber does not diminish the displacement of the structures floors but actually augments it. This behavior was expected since the mass absorber is supposed to work well at the first natural frequency of the structure when it has no bracings or absorber on it, and not so well at other frequencies. But the earthquake provides a wide range of frequencies all at the same time thus diminishing the benefits of the mass absorber.

The largest decrease in amplitude of the first floor occurred at 4.25 Hz, in which a reduction of 38% was observed. It was also at this frequency in which the amplitude of the second floor most decreased, a change of 42%.

The greatest increase in amplitude of the first floor occurred at 12.25 Hz, in which an increase of 294% was observed. This frequency also increased the amplitude of the second floor by 324%.

The mass absorber will not guarantee lower displacements of the floors under earthquake conditions.

The mass absorber proved to be an efficient method of damping the structure at it's first natural frequency, but grossly increased the amplitude beyond this point.

In contrast, a maximum decrease in amplitude of 79% for the first floor and a decrease of 85% for the second floor can be obtained with the invention. Such a substantial decrease in amplitude is attributed to the exceptional stiffening capabilities of the SMA pistons. This activation shifts the natural frequency of the modified building away from that of the original, hence the decrease in amplitude.

The maximum increase of amplitude occurred at 5.5 Hz in which the amplitude of the first floor increased by 81% and the second floor increased by 41%. This increase in amplitude can be accredited to the increase of the structure's stiffness during activation of the pistons. This stiffness induced an increase in the building's natural frequency, shifting it closer to the referenced value.

When activated, the pistons placed the model into rigid body motion. Therefore, the shifts in the original natural frequencies could not be measured.

This kind of bracing reflected a maximum decrease of floor displacement at 4.25 Hz. In which the amplitude of the first floor was decreased by 58% and the second floor was decreased by 71%. This change is also due to the stiffness the activated pistons contributed to the structure.

The largest increase of floor amplitude occurred at 5.5 Hz in which the amplitude was increased by 173% for the first floor, and a 78% increase for the second floor. Again, this enlargement of amplitude can be attributed to the change of stiffness in the building during piston activation.

When the bracing system is activated, the structure enters rigid body motion. Therefore, the increase in natural frequencies could not be measured.

This kind of bracing used SMA ribbons. The use of ribbons give the flexibility that the stiffness of the ribbons can be varied by changing the temperature of the ribbons, thus the electricity flowing, not like the pistons, that there were activated or not activated. This means that the stiffness of the building can be varied to different higher values not only one likes with the pistons.

This bracing shows a maximum decrease in amplitude of 36% for the first floor and a decrease of 29% for the second floor. The decrease in amplitude is attributed to not only the stiffness induced by the SMA members, but also their damping capabilities.

The increase in floor magnitude was at it's greatest when the frequency reached 14 Hz. At this point the amplitude of the first floor increased by 76% and the amplitude of the second floor increased by only 9%. Such a small increase in floor displacement as the structure approaches it's natural frequencies is due to the damping capabilities of this bracing system. Not only do the SMA members stiffen the structure, but they also introduce a large amount of energy absorption.

It will be apparent to those skilled in the art that various modifications and variations can be made in the disclosed process and product without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An apparatus comprising:

at least one structural member coupled to a building structure, said at least one structural member comprising a material which is at least one of shape and phase transformable in response to external energy actively applied thereto;

said at least one structural member being arranged to actively alter dynamic characteristics of the building structure, wherein a stiffness of the building structure is altered by application of external energy to said at least one structural member; and a controller which monitors a frequency of vibration in the building structure and which applies the external energy to said at least one structural member.

2. The structural member of claim 1, including:

a first end having an attachment portion for attaching said structural member to a first section of the building structure and a second attachment portion on the end of said member opposite to said first attachment portion, said second attachment portion for attaching said structural member to a second section of the building structure, said structural member allowing relative movement between the first and second sections of the building structure until said material undergoes said transformation.

3. The apparatus according to claim 1, wherein said at least one structural member further comprises:

a first end having an attachment portion for attaching said at least one structural member to a first section of the building structure;

a second attachment portion for attaching said at least one structural member to a second section of the building structure; and a third attachment portion for attaching said at least one structural member to the second section of the building structure, wherein said at least one structural member is arranged to allow relative movement between the first and second sections of the building structure until said material undergoes the transformation.

4. The apparatus according to claim 3, wherein said at least one structural member is V-shaped.

5. The structural member of claim 3, wherein said structural member is Y-shaped.

6. The apparatus according to claim 1, wherein said material is phase transformable, and wherein a phase transformation alters a modulus of elasticity of the material.

7. The apparatus according to claim 1, wherein said material is phase transformable, and wherein a phase transformation alters a vibration damping characteristic of said material.

8. The apparatus according to claim 1, wherein said material is shape transformable, and wherein a shape transformation in which said material expands, compresses the structural member.

9. The apparatus according to claim 1, wherein said material is shape transformable, and wherein shape transformation in which said material contracts, tensions the structural member.

10. The structural member of claim 2, wherein said material undergoes a shape transformation, and said shape transformation causes the material to contract, putting the structural member into tension.

11. The apparatus according to claim 3, comprising at least one of said first, second,. and third attachment portions including an attachment link having a slot coupable to one of said first and second section, wherein said slot defines a relative movement path between said at least one structural member and said one of said first and second section.

12. The apparatus according to claim 1 further comprising, an energy source coupled to said supply external energy to said at least one structural member.

13. The apparatus according to claim 1, wherein said energy source is structured and arranged to heat, whereby the heated material is transformed.

14. The apparatus according to claim 13, wherein said energy source is a power supply which generates an electrical current which is passed through said material, and wherein said material has an electrical resistance which creates heat when the current passes through said material.

15. The apparatus according to claim 1, wherein said controller comprises a feedback control loop including a thermocouple attached to said material wherein said feedback control loop functioning automatically turns off when said material reaches a maximum temperature and turns on when said material reaches minimum temperature.

16. The apparatus according to claim 1, wherein said controller operates in a real time environment.

17. The apparatus according to claim 1, wherein said material comprises a shape memory alloy.

18. The apparatus according to claim 1, wherein said material comprises an alloy including nickel and titanium.

19. The apparatus according to claim 1, wherein said application of external energy alters a natural frequency of the building structure.

20. The apparatus according to claim 1, wherein altering dynamic characteristics includes the natural frequency of the building structure.

21. The apparatus according to claim 3, wherein said at least one structural member is an inverted V-shape.

22. The apparatus according to claim 1, wherein said at least one structural member is non-load bearing until the active application of energy is applied, upon which then said at least structural member becomes load bearing.

23. A method for adjusting structural features of a building structure, said method including:

detecting a vibration in the building structure; and altering a natural frequency of the building structure by one of shape and transformation of at least one structural member in the building structure in response to the vibration.

24. The method of claim 23, including:

monitoring the frequency of the vibration acting on said building structure and actively changing the natural frequency of the building structure such that the natural frequency of the building structure does not match the frequency of the vibration.

25. The method of claim 24, further comprising applying an electrical current to the at least one structural member, whereby an inherent resistance of said material of the at least one structural member heats the at least one structural member.

26. A building structure comprising:

at least one structural member including a material that undergoes a controlled shape or phase transformation so that the natural frequencies of the building structure change by changing the stiffness of said building structure when said material undergoes said transformation.

27. The building structure of claim 26, wherein said building structure is a building having a plurality of vertically spaced floors;

said structural member having a first end attached to a first floor of the building and a second end opposite to said first end and attached to a second floor of the building, wherein said structural member inhibits relative movement between the first and second floors when said material undergoes said transformation.

28. The building structure of claim 26, wherein said building structure is a building having a plurality of vertically spaced floors;

said structural member having a first end attached to a first floor of the building, a second end attached to a second floor of the building, and a third end spaced from said first and second ends and attached to the second floor of the building, wherein said structural member inhibits relative movement between the first and second floors of the building structure when said material undergoes said transformation.

29. The building structure of claim 27, wherein said material is a shape memory alloy.

30. The building structure of claim 29, wherein said shape memory alloy is a nickel-titanium alloy.

31. The apparatus according to claim 29, wherein the electrical current is DC current.

32. The apparatus according to claim 29, wherein a temperature of said structural member is controlled by the amount of time said power supply is activated.

33. The apparatus according to claim 29, wherein a temperature of said structural member is controlled by a voltage and current supplied by said power supply when activated.

* * * * *